US009437908B2

(12) United States Patent
Vangala

(10) Patent No.: US 9,437,908 B2
(45) **Date of Patent: *Sep. 6, 2016**

(54) DIELECTRIC WAVEGUIDE FILTER WITH DIRECT COUPLING AND ALTERNATIVE CROSS-COUPLING

(71) Applicant: CTS Corporation, Elkhart, IN (US)

(72) Inventor: Reddy Vangala, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/708,870

(22) Filed: May 11, 2015

(65) Prior Publication Data

US 2015/0244049 A1 Aug. 27, 2015

Related U.S. Application Data

(63) Continuation of application No. 13/373,862, filed on Dec. 3, 2011, now Pat. No. 9,030,279.

(51) Int. Cl.
*H01P 1/20* (2006.01)
*H01P 7/10* (2006.01)
(Continued)

(52) U.S. Cl.
CPC ..... *H01P 1/2002* (2013.01); *H01P 1/207* (2013.01); *H01P 1/208* (2013.01); *H01P 1/2088* (2013.01); *H01P 7/10* (2013.01)

(58) Field of Classification Search
CPC ..... H01P 1/2002; H01P 7/10; H01P 1/2088; H01P 1/208; H01P 1/207
USPC ..... 333/202–212, 219.1
See application file for complete search history.

(56) References Cited

U.S. PATENT DOCUMENTS 3,882,434 A * 5/1975 Levy ..... 333/212
4,396,896 A 8/1983 Williams
(Continued)

FOREIGN PATENT DOCUMENTS

CN 201898182 U 7/2011
CN 102361113 A 2/2012
(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0/7803-8846-8 p. 269; figures 1,3.
(Continued)

*Primary Examiner* — Robert Pascal
*Assistant Examiner* — Rakesh Patel
(74) *Attorney, Agent, or Firm* — Daniel Deneufbourg

(57) ABSTRACT

A dielectric waveguide filter comprising a block of dielectric material including a plurality of resonators defined by a plurality of slots defined in the block of dielectric material. The resonators are arranged on the block of dielectric material in one or more rows and columns. First and second RF signal input/output electrodes are defined on the block of dielectric material. A first direct RF signal transmission path for the transmission of an RF signal is defined by the first and second RF signal input/output electrodes and the plurality of resonators. In one embodiment, internal windows define a first direct RF signal transmission means and additional RF signal transmission means define alternate or cross-coupling paths for the transmission of the RF signal from resonators in one column to resonators in another column. In one embodiment, the filter is comprised of two separate blocks of dielectric material which have been coupled together.

11 Claims, 6 Drawing Sheets

(51) Int. Cl.
*H01P 1/207* (2006.01)
*H01P 1/208* (2006.01)

(56) References Cited

U.S. PATENT DOCUMENTS 4,431,977 A 2/1984 Sokola et al.
4,609,892 A 9/1986 Higgins, Jr.
4,692,726 A 9/1987 Green et al.
4,706,051 A 11/1987 Dieleman et al.
4,733,208 A 3/1988 Ishikawa et al.
4,742,562 A 5/1988 Kommrusch
4,800,348 A 1/1989 Rosar et al.
4,806,889 A 2/1989 Nakano et al.
4,837,535 A 6/1989 Konishi et al.
4,940,955 A 7/1990 Higgins, Jr.
4,963,844 A 10/1990 Konishi et al.
4,996,506 A 2/1991 Ishikawa et al.
5,004,992 A 4/1991 Grieco et al.
5,023,944 A 6/1991 Bradley
5,130,682 A 7/1992 Agahi-Kesheh
5,208,565 A 5/1993 Sogo et al.
5,243,309 A 9/1993 L'Ecuyer
5,285,570 A 2/1994 Fulinara
5,288,351 A 2/1994 Hoang et al.
5,365,203 A 11/1994 Nakamura et al.
5,382,931 A 1/1995 Piloto et al.
5,416,454 A 5/1995 McVetty
5,525,946 A 6/1996 Tsujiguchi et al.
5,528,204 A 6/1996 Hoang et al.
5,528,207 A 6/1996 Ito
5,537,082 A 7/1996 Tada et al.
5,572,175 A 11/1996 Tada et al.
5,602,518 A 2/1997 Clifford, Jr. et al.
5,719,539 A 2/1998 Ishizaki et al.
5,731,751 A 3/1998 Vangala
5,821,836 A 10/1998 Katehi et al.
5,850,168 A 12/1998 McVetty et al.
5,926,078 A 7/1999 Hino et al.
5,926,079 A 7/1999 Heine et al.
5,929,726 A 7/1999 Ito et al.
5,999,070 A 12/1999 Endo
6,002,306 A 12/1999 Arakawa et al.
6,023,207 A 2/2000 Ito et al.
6,026,281 A * 2/2000 Yorita ..... H01P 1/2053 333/134
6,137,383 A 10/2000 De Lillo
6,154,106 A 11/2000 De Lillo
6,160,463 A 12/2000 Arakawa et al.
6,181,225 B1 1/2001 Bettner
6,255,921 B1 7/2001 Arakawa et al.
6,281,764 B1 8/2001 Arakawa et al.
6,329,890 B1 12/2001 Brooks et al.
6,351,198 B1 2/2002 Tsukamoto et al.
6,437,655 B1 8/2002 Andoh et al.
6,504,446 B1 1/2003 Ishihara et al.
6,535,083 B1 3/2003 Hageman et al.
6,549,095 B2 4/2003 Ishihara et al.
6,559,740 B1 5/2003 Schulz et al.
6,568,067 B2 5/2003 Takeda
6,594,425 B2 7/2003 Tapalian et al.
6,677,837 B2 1/2004 Kojima et al.
6,757,963 B2 7/2004 Meier et al.
6,791,403 B1 9/2004 Tayrani et al.
6,801,106 B2 10/2004 Ono et al.
6,834,429 B2 12/2004 Blair et al.
6,844,861 B2 1/2005 Peterson
6,888,973 B2 5/2005 Kolodziejski et al.
6,900,150 B2 5/2005 Jacquin et al.
6,909,339 B2 6/2005 Yonekura et al.
6,909,345 B1 6/2005 Salmela et al.
6,927,653 B2 8/2005 Uchimura et al.
6,977,560 B2 12/2005 Itoh et al.
6,977,566 B2 12/2005 Fukunaga
7,009,470 B2 3/2006 Yatabe et al.
7,068,127 B2 6/2006 Wilber et al.
7,132,905 B2 11/2006 Sano
7,142,074 B2 11/2006 Kim et al.
7,170,373 B2 1/2007 Ito et al.
7,271,686 B2 9/2007 Yoshikawa et al.
7,323,954 B2 1/2008 Lee et al.
7,449,979 B2 11/2008 Koh et al.
7,545,235 B2 6/2009 Mansour et al.
7,659,799 B2 2/2010 Jun et al.
7,714,680 B2 5/2010 Vangala et al.
8,008,993 B2 8/2011 Milsom et al.
8,072,294 B2 12/2011 Tanpo et al.
8,171,617 B2 5/2012 Vangala
8,284,000 B2 10/2012 Fukunaga
8,314,667 B2 11/2012 Uhm et al.
8,823,470 B2 9/2014 Vangala
9,130,255 B2 * 9/2015 Rogozine ..... H01P 1/2088
2001/0024147 A1 9/2001 Arakawa et al.
2002/0024410 A1 2/2002 Guglielmi et al.
2003/0006865 A1 1/2003 Kim et al.
2004/0000968 A1 1/2004 White et al.
2004/0056737 A1 3/2004 Carpintero et al.
2004/0129958 A1 7/2004 Koh et al.
2004/0257194 A1 12/2004 Casey et al.
2005/0057402 A1 3/2005 Ohno et al.
2007/0120628 A1 5/2007 Jun et al.
2009/0015352 A1 1/2009 Goebel et al.
2009/0102582 A1 4/2009 Van Der Heijden et al.
2009/0146761 A1 6/2009 Nummerdor
2009/0201106 A1 8/2009 Iio et al.
2009/0231064 A1 9/2009 Bates et al.
2010/0024973 A1 2/2010 Vangala
2010/0253450 A1 10/2010 Kim et al.
2011/0279200 A1 11/2011 Vangala
2012/0229233 A1 9/2012 Ito
2012/0286901 A1 11/2012 Vangala
2013/0214878 A1 8/2013 Gorisse et al.

FOREIGN PATENT DOCUMENTS

DE 102008017967 A1 10/2009
EP 0322993 A2 7/1989
EP 0322993 A3 4/1990
EP 0444948 A2 3/1991
EP 0757401 A2 2/1997
EP 0859423 A1 8/1998
EP 1024548 A1 2/2000
EP 0997964 A2 5/2000
EP 0997964 A3 9/2001
EP 1439599 A1 7/2004
FR 2318512 A1 2/1977
JP 62038601 2/1987
JP 2003298313 10/2003
WO 9509451 4/1995
WO 0024080 4/2000
WO 2005091427 9/2005

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

(56) References Cited

OTHER PUBLICATIONS

Y. Konishi, "Novel dielectric waveguide components-microwave applications of new ceramic materials," Proc. IEEE, vo. 79, pp. 726-740, Jun. 1991.
K. Sano, "Dielectric waveguide filter with low profile and low insertion loss," IEEE Trans. on Microwave Theory & Tech., vol. 47, pp. 2299-2303, Dec. 1999.
K. Sano and T. Yoneyama, "A transition from Microstrip to Dielectric Filled Rectangular Waveguide in Surface Mounting," IEEE MTT-S Int. Microwave Symp. Digest, pp. 813-816, 2002.
I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.
A.D. Paidus and C. Rossiter, "Cross-coupling in microwave bandpass filters," Microwave Journal, pp. 22-46, Nov. 2004.
Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771,1779, Aug. 2007.
Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.
Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.
Wolfram Wersing, Microwave ceramics for resonators and filters, Current Opinion in Solid State and Materials Science, vol. 1, Issue 5, Oct. 1996, pp. 715-731, ISSN 1359-0286.
Shen T et al, Full-Wave Design of Canonical Waveguide Filters by Optimation, 2001 IEEE MTT-S International Microwave Symposium Digest. (IMS 2001) Phoenix, AZ, May 20-25, 2001, pp. 1487-1490.
John David Rhodes, The Generalized Direct-Coupled Cavity Linear Phase Filter, IEEE Transactions on Microwave Theory and Techniques, vol. MTT-18, No. 6, Jun. 1, 1970, pp. 308-313, XP001401320, abstract.

* cited by examiner

L 1
L 2
L 1
2101
2102
2103
2104
2105
2106
2108
2109
2110
2112
2114
2116
2118
2120
2121
2122
2124
2125
2126
2128
2129
2130
2131
2132
2134
2136
2137
2138
2140
2142
2400
2401
2403
2404
2406
2500
2502
2504
2510
2512
2600
2622
2700
2722
2146
c
d

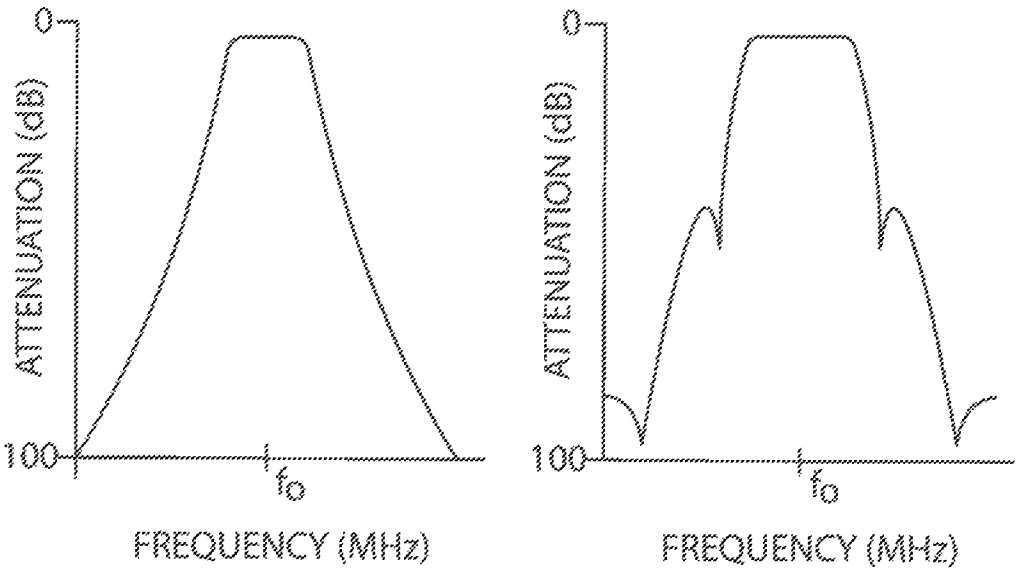
FIGURE 11
FIGURE 12
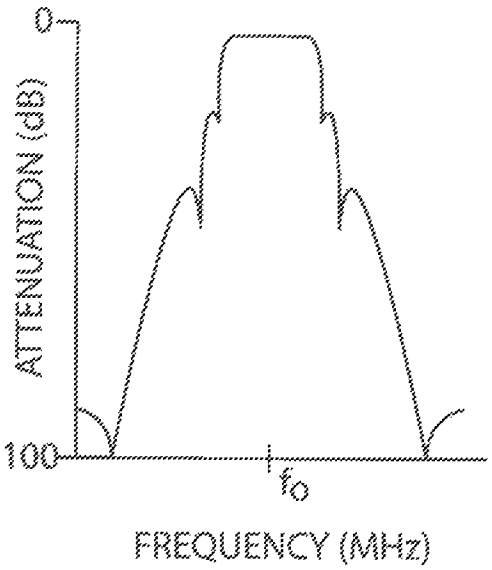
FIGURE 13

DIELECTRIC WAVEGUIDE FILTER WITH DIRECT COUPLING AND ALTERNATIVE CROSS-COUPLING

CROSS-REFERENCE TO RELATED AND CO-PENDING APPLICATION

This application is a continuation of, and claims the benefit of the filing date and disclosure of, U.S. application Ser. No. 13/373,862 filed on Dec. 3, 2011, the entire contents and disclosure of which is explicitly incorporated herein by reference as are all references cited therein.

FIELD OF THE INVENTION

The invention relates generally to dielectric waveguide filters and, more specifically, to a dielectric waveguide filter with direct coupling and alternative cross-coupling.

BACKGROUND OF THE INVENTION

This invention is related to a dielectric waveguide filter of the type disclosed in U.S. Pat. No. 5,926,079 to Heine et al. in which a plurality of resonators are spaced longitudinally along the length of a monoblock of dielectric/ceramic material and in which a plurality of slots/notches are spaced longitudinally along the length of the monoblock and define a plurality of RF signal bridges of dielectric material between the plurality of resonators which provide a direct inductive/capacitive coupling between the plurality of resonators.

The attenuation characteristics of a waveguide filter of the type disclosed in U.S. Pat. No. 5,926,079 to Heine et al. can be increased through the incorporation of zeros in the form of additional resonators located at one or both ends of the waveguide filter. A disadvantage associated with the incorporation of additional resonators, however, is that it also increases the length of the filter which, in some applications, may not be desirable or possible due to, for example, space limitations on a customer's motherboard.

The attenuation characteristics of a filter can also be increased by both direct and cross-coupling of the resonators as disclosed in, for example, U.S. U.S. Pat. No. 7,714,680 to Vangala et al. which discloses a monoblock filter with both inductive direct coupling and quadruplet cross-coupling of resonators created in part by respective metallization patterns which are defined on the top surface of the filter and extend between selected ones of the resonator through-holes to provide the disclosed direct and cross-coupling of the resonators.

Direct and cross-coupling of the type disclosed in U.S. Pat. No. 7,714,680 to Vangala et al. and comprised of top surface metallization patterns is not applicable in waveguide filters of the type disclosed in U.S. Pat. No. 5,926,079 to Heine et al. which includes only slots and no top surface metallization patterns.

The present invention is thus directed to a dielectric waveguide filter with both direct and optional or alternative cross-coupled resonators which allow for an increase in the attenuation characteristics of the waveguide filter without an increase in the length of the waveguide filter.

SUMMARY OF THE INVENTION

The present invention relates generally to a waveguide filter comprising a block of dielectric material, a plurality of resonators defined in the block of dielectric material by a plurality of slots defined in the block of dielectric material, the plurality of resonators being arranged on the block of dielectric material in one or more rows and columns; first and second RF signal input/output electrodes defined on the block of dielectric material; and the plurality of resonators and the first and second RF signal input/output electrodes together defining a first direct RF signal transmission path for the transmission of an RF signal through the waveguide filter.

In one embodiment, the first direct RF signal transmission path is defined in part by a first direct RF signal transmission means for directly transmitting the RF signal from a first one of the plurality of resonators in one of the columns of resonators to a first one of the plurality of resonators in another of the columns of the plurality of resonators.

In on embodiment, the first and second RF signal input/output electrodes are defined at the same end of the block of dielectric material and the first direct RF signal coupling path is generally U-shaped.

In one embodiment, the first direct RF signal transmission means is an internal window for transmitting the RF signal between the first one of the plurality of resonators in one of the columns of resonators to a first one of the plurality of resonators located in another of the columns of the plurality of resonators.

In one embodiment, the internal window is a region in the Interior of the block of dielectric material which is devoid of conductive material.

In one embodiment, the waveguide filter further comprises a first indirect RF signal transmission means defining a first indirect path for the transmission of the RF signal from a second one of the plurality of resonators in the one of the columns of resonators to a second one of the plurality of resonators in the other of the columns of resonators.

In one embodiment, the first indirect RF signal transmission means is an external RF signal transmission electrode defined on the outer surface of the block of dielectric material and extending between the second one of the plurality of resonators in the one of the columns of resonators to the second one of the plurality of resonators in the other of the columns of the plurality of resonators.

In one embodiment, the waveguide filter further comprises a second indirect RF signal transmission means defining a second indirect path for the transmission of the RF signal from a third one of the plurality of resonators in the one of the columns of resonators to a third one of the plurality of resonators in the other of the columns of resonators.

In one embodiment, the second RF signal transmission means is defined by an interior window for transmitting the RF signal between the third one of the plurality of resonators in the one of the columns of resonators to the third one of the plurality of resonators in the other of the columns of the plurality of resonators.

In one embodiment, the internal window is a region in the interior of the block of dielectric material devoid of conductive material.

In one embodiment, the first and second RF signal input/output electrodes are defined in part by first and second RF signal input/output pads defined on the block of dielectric material.

In one embodiment, first and second external RF signal connectors are coupled to the first and second RF signal input/output electrodes respectively.

In a particular embodiment, the present invention is directed to a waveguide filter which comprises a first block of dielectric material including a first plurality of slots defining a first plurality of resonators; a first RF signal input/output electrode defined on the first block of dielectric material; a second block of dielectric material coupled to the first block of dielectric material, the second block of dielectric material including a second plurality of slots defining a second plurality of resonators; a second RF signal input/output electrode defined on the second block of dielectric material; and a first direct RF signal transmission path defined by the combination of the first and second RF signal input/output electrodes and the plurality of resonators in the first and second blocks of dielectric material.

In one embodiment, the first direct RF signal transmission path is defined in part by a first direct RF signal transmission means extending from a first one of the plurality of resonators in the first block of dielectric material to a first one of the plurality of resonators in the second block of dielectric material.

In one embodiment, the first direct RF signal transmission means is defined by respective first and second RF signal transmission windows defined on the first and second blocks of dielectric material.

In one embodiment, the respective first and second RF signal transmission windows are defined by first and second regions of dielectric material.

In one embodiment, the waveguide filter further comprises a first indirect RF signal transmission means defining a first indirect coupling path for the transmission of the RF signal from a second one of the plurality of resonators in the first block of dielectric material to a second one of the plurality of resonators in the second block of dielectric material.

In one embodiment, the first indirect RF signal transmission means comprises an external RF signal transmission electrode defined on the outer surface of the block of dielectric material and extending between the second one of the plurality of resonators in the first block of dielectric material to the second one of the plurality of resonators in the second block of dielectric material.

In one embodiment, the waveguide filter further comprises a second indirect RF signal transmission means defining a second indirect coupling path for the transmission of the RF signal from a third one of the plurality of resonators in the first block of dielectric material to a third one of the plurality of resonators in the second block of dielectric material.

In one embodiment, the second indirect RF signal transmission line means comprises third and fourth windows defined on the first and second blocks of dielectric material.

In another particular embodiment, the present invention is directed to a dielectric waveguide filter comprising a block of dielectric material including a first plurality of resonators arranged in a first column and a second plurality of resonators arranged in a second column adjacent the first plurality of resonators; first and second RF signal input/output electrodes defined on the block of dielectric material; a first direct coupling RF signal transmission window defined in the interior of the block between one of the resonators in the first plurality of resonators and a first one of the resonators in the second plurality of resonators for transmitting an RF signal directly from the first plurality of resonators into the second plurality of resonators; a first indirect cross-coupling RF signal transmission means defined by an external transmission line extending between a second one of the resonators in the first plurality of resonators and a second one of the resonators in the second plurality of resonators for transmitting the RF signal between the second ones of the resonators in the first and second plurality of resonators; and a second indirect cross-coupling RF signal transmission means defined by an internal window located in the interior of the block of dielectric material between a third one of the resonators in the first plurality of resonators and a third one of the resonators in the second plurality of resonators for transmitting the RF signal between the third ones of the resonators in the first and second plurality of resonators.

In yet another embodiment, the first and second plurality of resonators are arranged on first and second blocks of dielectric material which have been coupled together.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying FIGURES as follows:

FIG. 11 is a graph representing the performance/frequency response of the ceramic dielectric waveguide filter depicted in FIG. 1;

FIG. 12 is a graph representing the performance/frequency response of the ceramic dielectric waveguide filters depicted in FIGS. 3, 7, and 9; and FIG. 13 is a graph representing the performance/frequency response of the ceramic dielectric waveguide filter depicted in FIG. 5.

DETAILED DESCRIPTION OF THE EMBODIMENTS

First Embodiment

Figure 1:
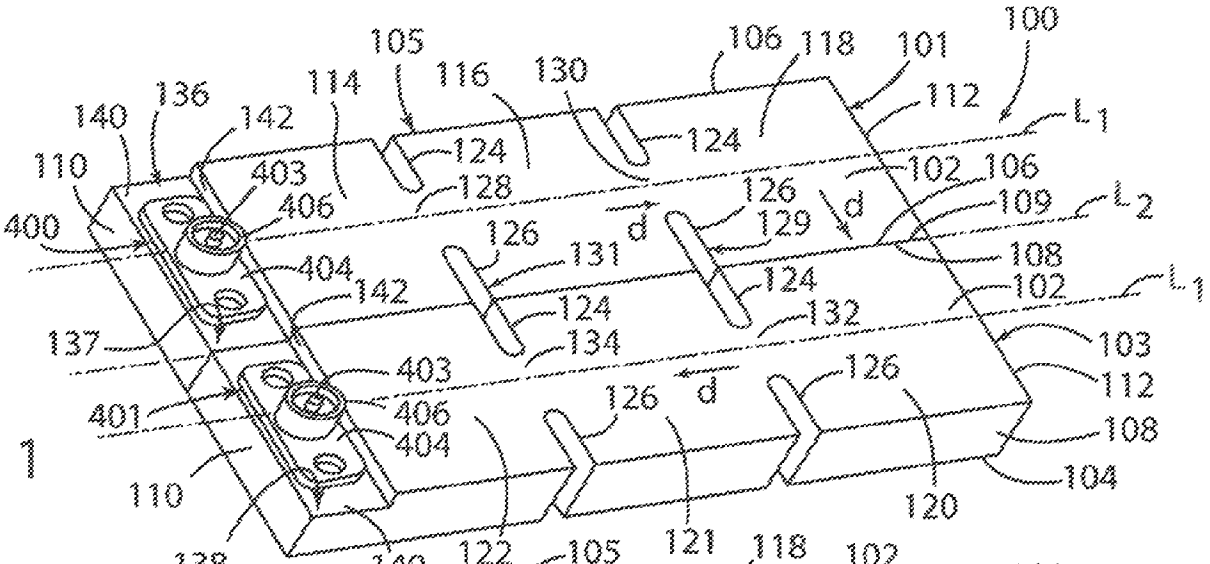
FIG. 1 is an enlarged perspective view of a dielectric waveguide filter according to the present invention.
Figure 2:
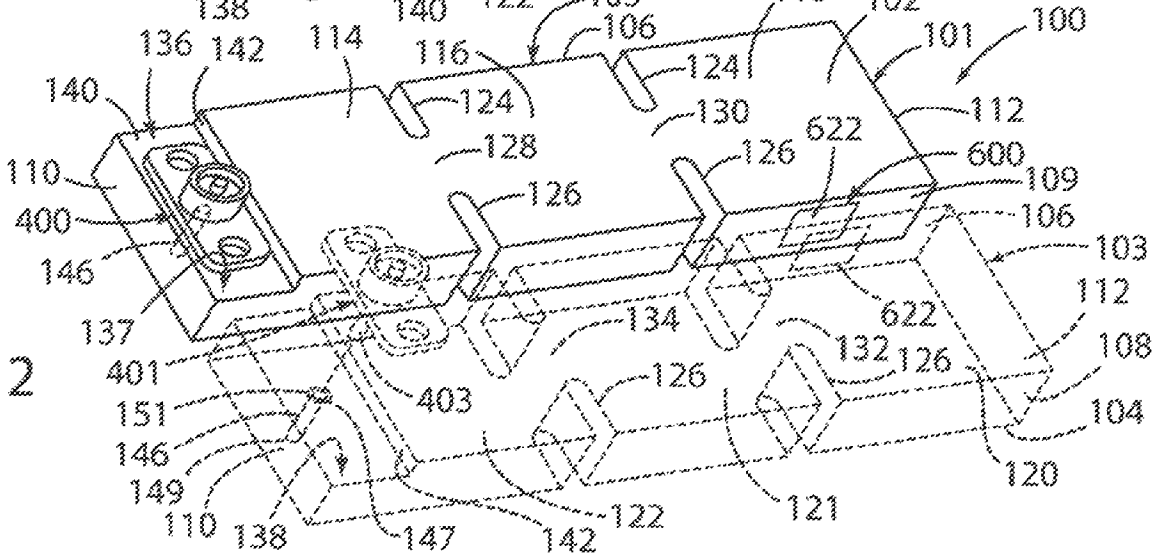
FIG. 2 is an enlarged, part exploded, part phantom perspective view of the dielectric waveguide filter shown in FIG. 1.

FIGS. 1 and 2 depict a first embodiment of a ceramic dielectric waveguide filter 100 in accordance with the present invention which incorporates only direct coupling characteristics and in which the attenuation characteristics of the waveguide filter 100 have been increased without increasing the length of the waveguide filter 100 as discussed and described in more detail below.

Initially, in the embodiment of FIGS. 1 and 2, the waveguide filter 100 is made from a pair of separate generally parallelepiped-shaped monoblocks 101 and 103 which have been coupled and secured together to form the waveguide filter 100 as also described in more detail below.

Each of the monoblocks 101 and 103 is comprised of a suitable dielectric material, such as for example ceramic; defines a longitudinal axis $L_1$; includes opposed longitudinal horizontal exterior surfaces 102 and 104 extending longitudinally in the same direction as the longitudinal axis $L_1$; opposed longitudinal side vertical exterior surfaces 106 and 108 extending longitudinally in the same direction as the longitudinal axis $L_1$; and opposed transverse side vertical exterior end surfaces 110 and 112 extending in a direction generally normal to the longitudinal axis $L_1$ of each of the monoblocks 101 and 103.

Each of the monoblocks 101 and 103 includes a plurality of resonant sections (also referred to as cavities or cells or resonators) 114, 116, and 118 and 120, 121, and 122 respectively which are arranged in respective columns and are spaced longitudinally along the length and longitudinal axis $L_1$ of the respective monoblocks 101 and 103 and are separated from each other by a plurality of (and more specifically two in the embodiment of FIGS. 1 and 2) pairs of spaced-apart vertical slits or slots 124 and 126 which are cut into the surfaces 102, 104, 106, and 108 of each of the monoblocks 101 and 103 and RF signal bridges 128, 130, 132, and 134 of dielectric material as described in more detail below.

The two slots 124 extend along the length of the side surface 106 of each of the monoblocks 101 and 103 in a spaced-apart and parallel relationship and in a relationship generally normal to the longitudinal axis $L_1$. Each of the slots 124 cuts through the side surface 106 and the opposed horizontal surfaces 102 and 104 and partially through the body and the dielectric material of each of the monoblocks 101 and 103.

The two slots 126 extend along the length of the opposed side surface 108 of each of the monoblocks 101 and 103 in a spaced-apart and parallel relationship, in a relationship generally normal to the longitudinal axis $L_1$, and in a relationship opposed, co-linear, and co-planar with the respective slots 124 defined in the side surface 106. Each of the slots 126 cuts through the side surface 108 and the opposed horizontal surfaces 102 and 104 and partially through the body and the dielectric material of each of the monoblocks 101 and 103.

By virtue of their opposed, spaced, co-linear, and co-planar relationship, each of the pairs of slots 124 and 126 together define a plurality of (and more specifically two in the embodiment of FIGS. 1 and 2) generally centrally located RF signal bridges 128 and 130 and RF signal bridges 132 and 134 in the monoblocks 101 and 103 respectively which are each comprised of a bridge or island of dielectric material which extends between the surfaces 102 and 104 of each of the monoblocks 101 and 103 in a relationship and orientation generally normal to and intersecting the longitudinal axis $L_1$ of each of the respective monoblocks 101 and 103 and interconnecting the respective resonators 114, 116, and 118 and the resonators 120, 121, and 122.

Specifically, the bridge 128 of dielectric material on the monoblock 101 bridges and interconnects the dielectric material of the resonator 114 to the dielectric material of the resonator 116, while the bridge 130 of dielectric material interconnects the dielectric material of the resonator 116 to the dielectric material of the resonator 118. In a similar manner, the bridge 132 of dielectric material on the monoblock 103 interconnects the dielectric material of the resonator 120 to the dielectric material of the resonator 121, while the bridge 134 of dielectric material bridges and Interconnects the dielectric material of the resonator 121 to the dielectric material of the resonator 122.

In the embodiment shown, the width of each of the RF signal bridges or islands of dielectric material 128, 130, 132, and 134 is dependent upon the distance between the opposed slots 124 and 126 and, in the embodiment shown, is approximately one-third the width of each of the monoblocks 101 and 103.

Although not shown in any of the FIGURES, it is understood that the thickness or width of the slots 124 and 126 and the depth or distance which the slots 124 and 126 extend from the respective one of the side surfaces 106 or 108 into the body and dielectric material of each of the monoblocks 101 and 103 may be varied depending upon the particular application to allow the width and the length of the RF signal bridges 128, 130, 132, and 134 to be varied accordingly to allow control of the electrical coupling and bandwidth of the waveguide filter 100 and hence control the performance characteristics of the waveguide filter 100.

The monoblocks 101 and 103 additionally comprise and define respective end steps or notches 136 and 138 respectively and each comprising, in the embodiment shown, a generally L-shaped recessed or grooved or shouldered or notched region or section of the longitudinal surface 104, opposed side surfaces 106 and 108, and opposed side end surfaces 110 and 112 of the respective monoblocks 101 and 103, and more specifically of the respective end resonators 114 and 122, from which dielectric ceramic material has been removed or is absent.

Stated another way, the respective steps 136 and 138 are defined in and by an end section or region of each of the respective monoblocks 101 and 103, and more specifically the respective end resonators 114 and 122, having a height less than the height of the remainder of the respective monoblocks 101 and 103.

Stated yet another way, the respective steps 136 and 138 each comprise a generally L-shaped recessed or notched portion of the respective end resonators 114 and 122 defined on the respective monoblocks 101 and 103 which includes a first generally horizontal surface 140 located or directed inwardly of, spaced from, and parallel to the surface 104 of the respective monoblocks 101 and 103 and a second generally vertical surface or wall 142 located or directed inwardly of, spaced from, and parallel to, the respective side end surfaces 110 and 112 of the respective monoblocks 101 and 103.

The monoblocks 101 and 103 additionally each comprise an electrical RF signal input/output electrode in the form of respective through-holes 146 extending through the body of the respective monoblocks 101 and 103 in a relationship generally normal to the longitudinal axis $L_1$ thereof and, more specifically, through the respective steps 136 and 138 thereof and, still more specifically, through the body of the respective end resonators 114 and 122 defined in the respective monoblocks 101 and 103 between, and in relationship generally normal to, the surface 140 of the respective steps 136 and 138 and the surface 104 of the respective monoblocks 101 and 103.

Still more specifically, the respective RF signal input/output through-holes 146 are spaced from and generally parallel to the respective transverse side end surface 110 of the respective monoblocks 101 and 103 and define respective generally circular openings 147 and 149 shown in FIG. 2 and terminating in the step surface 140 and the monoblock surface 104 respectively of each of the respective monoblocks 101 and 103.

The RF signal input/output through-holes 146 are located and positioned in and extend through the interior of the respective monoblocks 101 and 103 and the respective steps 136 and 138 between and, in a relationship generally spaced from and parallel to, the side end surface 110 and the step wall or surface 142.

All of the external surfaces 102, 104, 106, 108, 110, and 112 of the monoblocks 101 and 103, the internal surfaces of the slots 124 and 126, and the internal surfaces of the input/output through-holes 146 are covered with a suitable conductive material, such as for example silver, with the exception of the regions described in more detail below including a region 151 of dielectric material surrounding the opening 147 defined by the respective through-holes 146 in the surface 140 of the respective steps 136 and 138.

The monoblocks 101 and 103 still further comprise respective SMA RF signal input/output co-axial connectors 400 and 401, each including a generally rectangularly-shaped connector base plate or flange 404, a generally cylindrically-shaped connector housing or shell 406 extending generally normally unitarily upwardly and outwardly from the top surface of the flange 404, and an elongated center connector pin 403 extending through both the interior of the shell 406 and the body of the flange 404.

The respective connectors 400 and 401, and more specifically, the respective base plates or flanges 404 thereof, are seated against the respective steps 136 and 138 of the respective monoblocks 101 and 103 in a relationship generally normal to the side surfaces 106 and 108 and longitudinal axis $L_1$ of the respective monoblocks 101 and 103 wherein the flange 404 of the respective connectors 400 and 401 are seated against the surface 140 of the respective steps 136 and 138 and the shell 406 is co-axially aligned with the respective through-holes 146 defined in the respective steps 136 and 138.

The connector flange 404 is directly soldered to the surface 140 of the respective steps 136 and 138 of the respective monoblocks 101 and 103 and the connector pin 403 extends into and is reflow-soldered to the conductive material in the interior of the respective through-holes 146.

As shown in FIG. 1, the separate monoblocks 101 and 103 are, in the embodiment shown, coupled and secured to each other to define and form the waveguide filter 100 in accordance with the present invention in which a plurality of resonators are arranged in one or more rows and columns and, more specifically, in the embodiment shown, in a relationship in which six resonators 114, 116, 118, 120, 121, and 122 are arranged in two columns and three rows as described in more detail below.

Specifically, and as shown in FIG. 1, the monoblocks 101 and 103 are coupled and secured together to define the waveguide filter 100 in a relationship wherein the vertical side surface 108 of the monoblock 101 is abutted against and secured to the vertical side surface 106 of the monoblock 103; the slots 126 on the monoblock 101 are co-linearly aligned with the slots 124 on the monoblock 103 to define a pair of respective elongate, spaced-apart, and parallel internal or interior slots 129 and 131 located in the center of the waveguide filter 100 in a relationship generally normal to the longitudinal axis $L_1$ of the monoblocks 101 and 103 and in a relationship co-linearly aligned with the respective exterior or peripheral slots 124 defined in the surface 106 of the monoblock 101 and the exterior or peripheral slots 126 defined in the surface 108 of the monoblock 103; and the step 136 on the monoblock 101 is abutted against and aligned with the step 138 on the monoblock 103.

Thus, in the relationship as shown in FIG. 1, the resonators 114, 116, and 118 on the monoblock 101 defining the waveguide filter 100 are arranged in a first column; the resonators 120, 121, and 122 on the monoblock 103 defining the filter 100 are arranged in an abutting second column; the respective resonators 114 and 122 on the respective monoblocks 101 and 103 defining the waveguide filter 100 are disposed in an abutting, side-by-side row relationship; the respective resonators 116 and 121 on the respective monoblocks 101 and 103 defining the waveguide filter 100 are disposed in an abutting, side-by-side row relationship; and the respective resonators 118 and 120 on the respective monoblocks 101 and 103 defining the waveguide filter 100 are disposed in an abutting, side-by-side row relationship.

As shown in FIG. 2, the waveguide filter 100 also comprises a first direct coupling RF signal transmission means 600 for directly transmitting and coupling the RF signal from the resonator 118 on the monoblock 101 to the resonator 120 on the monoblock 103.

In the embodiment of FIGS. 1 and 2, the direct RF signal transmission means 600 comprises respective interior or internal regions or windows or apertures 622 of dielectric material (i.e, regions devoid of conductive material) which are defined on the respective exterior side surfaces 106 and 108 of the respective monoblocks 101 and 103 in the region of the respective resonators 118 and 120 and which are adapted to be abutted against each other to define the internal or interior direct coupling RF signal transmission means 600 and interior or internal direct coupling path for the transmission of the RF signal from the resonator 118 into the resonator 120 as described in more detail below.

Thus, the assembled or finished waveguide filter 100 as shown in FIG. 1, comprises a block 105 of dielectric material defined by the two monoblock portions 101 and 103 and defining a central longitudinal axis $L_2$; a pair of opposed and spaced-apart top and bottom horizontal exterior surfaces 102 and 104 extending in the same direction as the longitudinal axis $L_2$; a pair of opposed and spaced-apart vertical exterior surfaces 106 and 108 extending in the same direction as the longitudinal axis $L_2$; and a pair of opposed and spaced-apart vertical exterior end surfaces 110 and 112 extending in a direction transverse to the longitudinal axis $L_2$.

The finished waveguide filter 100 further comprises an elongate end step or notch 137 which is defined by the combination of the steps 136 and 138, and thus the description above with respect to the structure of the steps 136 and 138 is incorporated herein by reference with respect to the structure of the step 137.

The step or notch 137 is defined in the block 105 of dielectric material in a region thereof adjoining the transverse end surface 104 thereof and extends in a direction normal to the longitudinal axis $L_2$ of the block 105 between the side surface 106 and the side surface 108. The step 137 includes a horizontal surface 140 which is spaced inwardly from and generally parallel to the exterior surface 102 of the block of the waveguide filter 100 and a vertical surface or wall 142 which is spaced inwardly from and parallel to the block end side vertical surface 110.

The waveguide filter 100 still further comprises a pair of RF signal input/outputs or electrodes defined in part by the pair of RF signal input/output through-holes 146, the above description of which is incorporated herein by reference, which extend through the body and dielectric material of the block 105 in a relationship and direction generally normal to the longitudinal axis $L_2$ and terminating in openings in the step surface 140 and block surface 104 respectively.

As shown in FIG. 2, the first one of the pair of through-holes 146 is located and defined in the step 137 in a region thereof located above the longitudinal axis $L_2$ and spaced from the end surface 104, while the second one of the pair of through-holes 146 is located and defined in the step 137 in a region thereof located below the longitudinal axis $L_2$, spaced from the end surface 104, and co-linear with the first of the pair of through-holes 146.

The waveguide filter 100 still further comprises the pair of SMA RF signal input/output co-axial connectors 400 and 401, the above description of which is incorporated herein by reference, which are seated on the surface 140 of the step 137 in a spaced-apart and co-linear relationship and coupled to the RF signal input/output through-holes 146 respectively.

The waveguide filter 100 still further comprises and defines the pair of spaced-apart and generally parallel elongate slots 124, the above description of which is incorporated herein by reference, extending from the side surface 106 of the block 105 into the body and dielectric material of the block 105 in a relationship generally normal to both the side surface 106 and the longitudinal axis $L_2$ of the block 105; and the pair of spaced-apart and parallel elongate slots 126, the above description of which is also incorporated herein by reference, extending from the side surface 108 of the block 105 into the body and dielectric material of the block 105 in a relationship generally normal to both the side surface 108 and the longitudinal axis $L_2$ of the block 105 and further in a relationship co-linear with, and spaced from, the respective slots 124. The slots 124 and 126 extend between and through the top and bottom exterior surfaces 102 and 104 and the respective side surfaces 106 and 108 of the block 105 of the waveguide filter 100.

The waveguide filter 100 still further comprises and defines the pair of generally oval-shaped and centrally located elongate, spaced-apart, parallel, and interior slots 129 and 131, the above description of which is incorporated herein by reference, which are oriented in a relationship generally normal to and intersecting the longitudinal axis $L_2$ and extend through the body and dielectric material of the block 105 and terminate in respective generally oval-shaped openings in the top and bottom exterior surfaces 102 and 104 of the block 105 of the waveguide filter 100.

The slot 129 is located in the block 105 of the waveguide filter 100 in a relationship co-linear with, between, and spaced from the one of the pairs of slots 124 and 126, while the slot 131 is located in the block 105 of the waveguide filter 100 in a relationship spaced from and generally parallel to the slot 129 and co-linear with, between, and spaced from the other of the pairs of slots 124 and 126.

In the embodiment of FIGS. 1 and 2, all of the exterior surfaces 102, 104, 106, 108, 110, 112 of the block 105; the interior surface of each of the slots 124, 126, 129, and 131; and the interior surface of each of the RF signal input/output through-holes 146 are covered with a layer of conductive material, with the exception of the region 151 of the exterior top surface 102 surrounding the opening 147 defined in the exterior top surface 102 by the respective RF signal input/output through-holes 146 and the interior window 622 as described above.

Additionally, in the embodiment of FIGS. 1 and 2, a central interior elongate layer or wall 109 of conductive material extends vertically through the full length and height of the body of the block 105 of the waveguide filter 100 in a relationship co-linear and co-planar with the longitudinal axis $L_2$ of the block 105 of the waveguide filter 100, with the exception of the small interior or internal window 622 of dielectric material defined in the layer or wall 109 of conductive material as described in more detail above.

The combination of the block 105 of dielectric material, the slots 124, 126, 129, and 131, and the conductive material as described in more detail above define and create the two rows and columns of RF signal resonators 114, 116, 118, 120, 121, and 122 and connecting RF signal bridges of dielectric material 128, 130, 132, and 134 of the waveguide filter 100 of the present invention as depicted in FIGS. 1 and 2 and described above in detail in which the resonators 114 and 122, the resonators 116 and 121, and the resonators 118 and 120 are disposed in a side-by-side relationship and are electrically separated from each other by the central interior layer or wall 109 of conductive material except as discussed below.

In accordance with the invention, the waveguide filter 100 defines a first magnetic or inductive generally U-shaped direct coupling RF signal transmission path or transmission line for RF signals generally designated by the arrows d in FIG. 1 successively through the connector 400 seated on the step 137 in the embodiment where the connector 400 defines the RF signal input connector; the first RF signal transmission input through-hole 146 extending through the step 137 and, more specifically, extending through the step 136 formed in the monoblock 101; the step 137 in the block 105 and, more specifically, the step 136 in the resonator 114 of the monoblock 101; the resonator 114 in the block 105 and, more specifically, the resonator 114 in the monoblock 101; the resonator 116 in the block 105 and, more specifically, the resonator 116 in the monoblock 101 via and through the RF signal bridge 128; and the resonator 118 in the block 105 and, more specifically, the resonator 118 in the monoblock 101 via and through the RF signal bridge 130.

Thereafter, the RF signal is transmitted into the resonator 120 of the block 105 and, more specifically, into the resonator 120 of the monoblock 103 via and through the internal direct coupling RF signal transmission means 600 defined by the internal RF signal transmission window 622 defined in the interior of the block 105 between the two resonators 118 and 120 and, more specifically, the window 622 defined in the interior layer 109 of conductive material located between and separating the two monoblocks 101 and 103 of the block 105 and, more specifically, between and separating the two resonators 118 and 120; the resonator 121 in the block 105 and, more specifically, the resonator 121 in the monoblock 103 via the RF signal bridge 132; the resonator 122 in the block 105 and, more specifically, the resonator 122 in the monoblock 103 via and through the RF signal bridge 134; the step 137 of the block 105 and, more specifically, the step 138 at the end of the resonator 122 of the monoblock 103; the RF signal transmission output through-hole 146 in the step 137 of the block 105 and, more specifically, the step 138 in the resonator 122 of the monoblock 103; and out through the RF signal output connector 401 seated on the step 137 of the block 105 and, more specifically, seated on the step 138 of the monoblock 103.

Thus, in accordance with the present invention, the structure of the waveguide filter 100 and, more specifically, the use of a waveguide filter 100 in which the block 105, the monoblocks 101 and 103 defining the same, and the respective resonators 114, 116, 118, 120, 121, and 122 thereof, have been arranged and coupled together in a column and row and side-by-side relationship as described in detail above and in which a direct coupling RF signal transmission means 600 directly couples the resonators 118 and 120 in the respective monoblocks 101 and 103 as also described above, and through which the RF signal is transmitted as also described above, defines and provides a waveguide filter 100 with improved attenuation, an increased number of resonators, and an RF signal path/transmission line of increased length, as compared to for example the lesser number of resonators and shorter length of the RF signal path/transmission line of the waveguide filter disclosed in co-pending U.S. Patent Application Ser. No. 61/345,382, without an increase in the length of the waveguide filter.

FIG. 11 is a graph of the performance/frequency response of the waveguide filter 100 shown in FIG. 1 in which Attenuation (measured in dB) is shown along the vertical axis and Frequency (measured in MHz) is shown along the horizontal axis.

Second Embodiment

Figure 3:
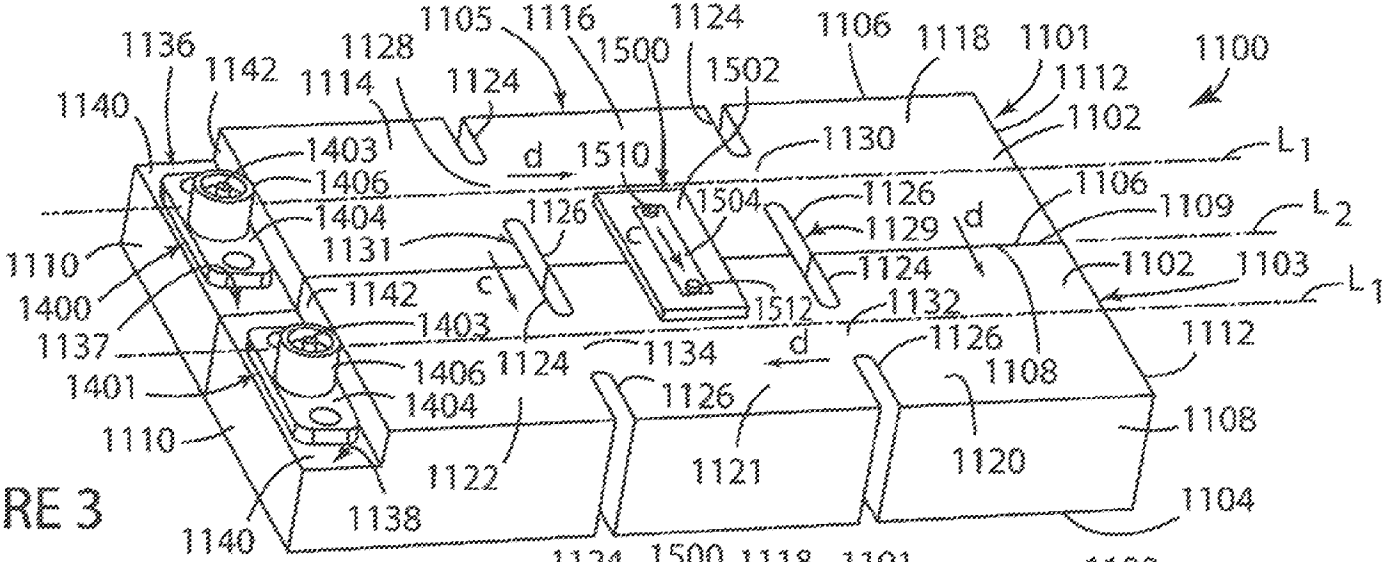
FIG. 3 is an enlarged perspective view of another embodiment of a dielectric waveguide fitter according to the present invention.
Figure 4:
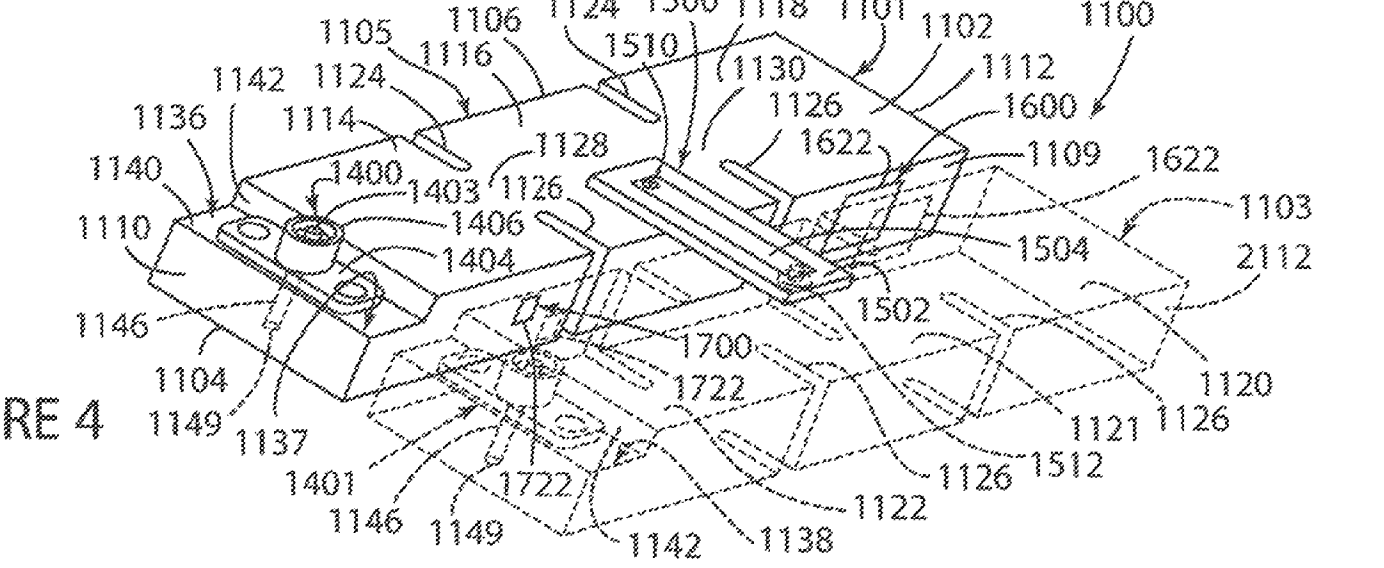
FIG. 4 is an enlarged, part exploded, part phantom perspective view of the dielectric waveguide filter shown in FIG. 3.

FIGS. 3 and 4 depict a waveguide filter 1100 which incorporates not only the direct RF signal coupling and transmission features and characteristics of the waveguide filter 100 shown in FIGS. 1 and 2 but also alternate cross-coupling/indirect RF signal coupling and transmission features and characteristics as discussed in more detail below.

The waveguide filter 1100, in the same manner as the waveguide filter 100 described above and thus incorporated herein by reference is, in the embodiment of FIGS. 3 and 4, made from a pair of separate generally parallelepiped-shaped monoblocks 1101 and 1103 which have been coupled and secured together to form the waveguide filter 1100 as described in more detail below. Each of the monoblocks 1101 and 1103 is comprised of a suitable dielectric material, such as for example ceramic; defines a longitudinal axis $L_1$; includes opposed and spaced-apart longitudinal horizontal exterior surfaces 1102 and 1104 extending longitudinally in the same direction as the longitudinal axis $L_1$; opposed and spaced-apart longitudinal side vertical exterior surfaces 1106 and 1108 extending longitudinally in the same direction as the longitudinal axis $L_1$; and opposed and spaced-apart transverse side vertical exterior end surfaces 1110 and 1112 extending in a direction generally normal to the longitudinal axis $L_1$ of each of the monoblocks 1101 and 1103.

The monoblocks 1101 and 1103 include respective pluralities of resonant sections (also referred to as cavities or cells or resonators) 1114, 1116, and 1118 and 1120, 1121, and 1122 which are respectively arranged in a column relationship and are spaced longitudinally along the length and longitudinal axis $L_1$ of the respective monoblocks 1101 and 1103 and are separated from each other by a plurality of (and more specifically two in the embodiment of FIGS. 3 and 4) spaced-apart vertical slits or slots 1124 and 1126 which are cut into the surfaces 1102, 1104, 1106, and 1108 of the respective monoblocks 1101 and 1103 and interconnected together by RF signal bridges 1128, 1130, 1132, and 1134 of dielectric material as described in more detail below.

The two slots 1124 extend along the length of the side surface 1106 of each of the monoblocks 1101 and 1103 in a spaced-apart and parallel relationship and in a relationship generally normal to the longitudinal axis $L_1$. Each of the slots 1124 cuts through the side surface 1106 and the opposed horizontal surfaces 1102 and 1104 and partially through the body and the dielectric material of each of the monoblocks 1101 and 1103.

The two slots 1126 extend along the length of the opposed side surface 1108 of each of the monoblocks 1101 and 1103 in a spaced-apart and parallel relationship, in a relationship generally normal to the longitudinal axis $L_1$, and in a relationship opposed, co-linear, and co-planar with the respective slots 1124 defined in the side surface 1106. Each of the slots 1126 cuts through the side surface 1108 and the opposed horizontal surfaces 1102 and 1104 and partially through the body and the dielectric material of each of the monoblocks 1101 and 1103.

By virtue of their opposed, spaced, co-linear, and co-planar relationship, each of the pairs of slots 1124 and 1126 together define a plurality of (and more specifically two in the embodiment of FIGS. 3 and 4) generally centrally located RF signal bridges 1128 and 1130 in the monoblock 1101 which extend between and interconnect the resonators 1114, 1116, and 1118 and RF signal bridges 1132 and 1134 in the monoblock 1103 which extend between and interconnect the resonators 1120, 1121, and 1122 and are each comprised of a bridge or island of dielectric material which extends between the surfaces 1102 and 1104 of each of the monoblocks 1101 and 1103 in a relationship and orientation generally normal to and intersecting the longitudinal axis $L_1$ of each of the respective monoblocks 1101 and 1103.

Specifically, the bridge 1128 of dielectric material bridges and interconnects the dielectric material of the resonator 1114 to the dielectric material of the resonator 1116, while the bridge of dielectric material 1130 bridges and interconnects the dielectric material of the resonator 1116 to the dielectric material of the resonator 1118. In a like manner, the bridge 1132 of dielectric material on the monoblock 1103 bridges and interconnects the dielectric material of the resonator 1120 to the dielectric material of the resonator 1121, while the bridge 1134 of dielectric material bridges and interconnects the dielectric material of the resonator 1121 to the dielectric material of the resonator 1122.

In the embodiment shown, the width of each of the RF signal bridges 1128, 1130, 1132, and 1134 is dependent upon the distance between the opposed slots 1124 and 1126 and, in the embodiment shown, is approximately one-third the width of each of the monoblocks 1101 and 1103.

The thickness, width, and depth of the slots 1124 and 1126 may be varied to vary the width and length of the respective RF signal bridges 1118, 1130, 1132, and 1134.

The monoblocks 1101 and 1103 additionally comprise and define respective end steps or notches 1136 and 1138 each comprising, in the embodiment shown, a generally L-shaped recessed or grooved or shouldered or notched region or section of the longitudinal surface 1104, opposed side surfaces 1106 and 1108, and opposed side end surfaces 1110 and 1112 of the respective monoblocks 1101 and 1103, and more specifically of the respective resonators 1114 and 1122, from which dielectric ceramic material has been removed or is absent.

All of the features and characteristics of the steps 1136 and 1138 are identical to the features and characteristics of the steps 136 and 138 of the waveguide filter 100 and thus the earlier description of such features and characteristics is incorporated herein by reference for the steps 1136 and 1138.

The monoblocks 1101 and 1103 additionally each comprise an electrical RF signal input/output electrode in the form of respective through-holes 1146 which extend through the body of the respective monoblocks 1101 and 1103 in a direction normal to and co-linear with the longitudinal axis $L_1$ thereof and, more specifically, through the respective steps 1136 and 1138 thereof and, still more specifically, through the body of the respective end resonators 1114 and 1122 defined in the respective monoblocks 1101 and 1103 between, and in a relationship generally normal to, the surface 1140 of the respective steps 1136 and 1138 and the surface 1104 of the respective monoblocks 1101 and 1103.

Still more specifically, the respective RF signal input/output through-holes 1146 are spaced from and generally parallel to the respective transverse side end surface 1110 of the respective monoblocks 1101 and 1103 and define respective generally circular openings located and terminating in the step surface 1140 and the monoblock surface 1104 respectively. FIG. 4 shows only the openings 1149 defined in the step surface 1140.

The RF signal input/output through-holes 1146 are located and positioned in and extend through the interior of the respective monoblocks 1101 and 1103 and the respective steps 1136 and 1138 between and, in a relationship generally spaced from and parallel to, the side end surface 1110 and the step wall or surface 1142.

All of the external surfaces 1102, 1104, 1106, 1108, 1110, and 1112 of the monoblocks 1101 and 1103, the internal surfaces of the respective slots 1124 and 1126, and the internal surfaces of the input/output through-holes 1146 are covered with a suitable conductive material, such as for example silver, with the exception of the regions described in more detail below and the region (not shown) but identical to the region 151 shown in FIG. 2 which surrounds the opening defined in the step surface 1140 by the respective through-holes 1146.

The monoblocks 1101 and 1103 still further comprise respective SMA RF signal input/output co-axial connectors 1400 and 1401, each including a generally rectangularly-shaped connector base plate or flange 1404, a generally cylindrically-shaped connector housing or shell 1406 extending generally normally unitarily upwardly and outwardly from the top surface of the flange 1404, and an elongated center connector pin 1403 extending through both the interior of the shell 1406 and the body of the flange 1404.

The respective connectors 1400 and 1401 are seated against the respective steps 1136 and 1138 of the respective monoblocks 1101 and 1103 in a relationship generally normal to the side surfaces 1106 and 1108 of the respective monoblocks 1101 and 1103 wherein the base plate 1404 of the respective connectors 1400 and 1401 is seated against the surface 1140 of the respective steps 1136 and 1138 and the shell 1406 is co-axially aligned with the respective through-holes 1146 defined in the respective steps 1136 and 1138.

The connector flange 404 is directly soldered to the surface 140 of the respective steps 136 and 138 of the respective monoblocks 101 and 103 and the connector pin 403 extends into and is reflow-soldered to the conductive material in the interior of the respective through-holes 146.

As shown in FIG. 3, the separate monoblocks 1101 and 1103 are coupled and secured to each other to define and form the waveguide filter 1100 in the same manner as described above with respect to the waveguide filter 100 in which the plurality of resonators 1114, 1116, 1118, 1120, 1121, and 1122 are arranged in two columns and three rows in the same manner as resonators 114, 116, 118, 120, 121, and 122 of the waveguide filter 100, and thus the description above is incorporated herein by reference with respect to the waveguide filter 1100.

Specifically, and as shown in FIG. 3, the monoblocks 1101 and 1103 are coupled and secured together to define the waveguide filter 1100 in a relationship wherein the vertical side surface 1108 of the monoblock 1101 is abutted against and secured to the vertical side surface 1106 of the monoblock 1103; the slots 1126 on the monoblock 1101 are co-linearly aligned with the slots 1124 on the monoblock 1103 to define and form a pair of respective elongate, spaced-apart, and parallel internal or interior elongate slots 1129 and 1131 located in the center of the waveguide filter 1100 in a relationship generally normal to the longitudinal axis $L_1$ of the monoblocks 1101 and 1103 and in a relationship co-linearly aligned with the respective exterior or peripheral slots 1124 defined in the surface 1106 of the monoblock 1101 and the exterior or peripheral slots 1126 defined in the surface 1108 of the monoblock 1103; and the step 1136 on the monoblock 1101 is abutted against and aligned with the step 1138 on the monoblock 1103.

Thus, in the relationship as shown in FIG. 3, the resonators 1114, 1116, and 1118 on the monoblock 1101 defining the waveguide filter 1100 are arranged in a first column; the resonators 1120, 1121, and 1122 on the monoblock 1103 defining the waveguide filter 1100 are arranged in a second abutting column; respective resonators 1114 and 1122 on the respective monoblocks 1101 and 1103 are disposed in an abutting, side-by-side and row relationship; the respective resonators 1116 and 1121 on the respective monoblocks 1101 and 1103 are disposed in an abutting, side-by-side and row relationship; and the respective resonators 1118 and 1120 on the respective monoblocks 1101 and 1103 are disposed in an abutting, side-by-side and row relationship.

The waveguide filter 1100 further comprises a first direct coupling RF signal transmission means 1600 (identical to the RF signal transmission means 600 described above, the description of which is thus incorporated herein by reference) for directly transmitting an RF signal directly between the respective resonators 1118 and 1120 on the respective monoblocks 1101 and 1103.

In the embodiment of FIGS. 3 and 4, the direct-coupling RF signal transmission means 1600 includes respective interior or internal RF signal transmission windows or regions or apertures 1622 defined on the respective exterior side surfaces 1106 and 1108 of the respective monoblocks 1101 and 1103 in the region of and between the respective resonators 1118 and 1120 which are devoid of conductive material (i.e, regions or apertures 1622 of dielectric material) and are abutted against each other to define the direct coupling RF signal transmission means 1600 and direct path for the transmission of the RF signal from the resonator 1118 in the monoblock 1101 into the resonator 1120 in the monoblock 1103.

The waveguide filter 1100 differs from the waveguide filter 100 in that the waveguide filter 1100 additionally comprises a first indirect, alternative, or cross-coupling RF signal transmission means which, in the embodiment shown, is in the form of an external, cross-coupling/indirect coupling, bypass or alternate RF signal transmission electrode or bridge member or transmission line 1500 having a specific impedance and phase and extending between and interconnecting and electrically coupling and interconnecting the respective resonators 1116 and 1121 of the respective monoblocks 1101 and 1103.

In the embodiment shown, the external cross-coupling transmission line 1500 includes and is defined by a generally rectangularly-shaped printed circuit board 1502 which is seated on and bridges the respective top surfaces 1102 of the respective monoblocks 1101 and 1103. The external cross-coupling transmission electrode 1500 additionally includes an elongated strip of conductive material 1504 defined and formed on the top surface of the printed circuit board 1502 which bridges and extends over the respective resonators 1116 and 1121 on the respective monoblocks 1101 and 1103.

Moreover, and although not shown in FIG. 3, it is understood that the printed circuit board 1502 additionally includes and defines respective internal through-holes extending through the body of the printed circuit board 1502 and adapted to receive respective conductive posts 1510 and 1512 extending outwardly from the respective top surfaces 1102 of the respective resonators 1116 and 1121 of the respective monoblocks 1101 and 1103 into contact with opposed end sections of the elongate strip of conductive material 1504 for electrically cross-coupling the resonators 1116 and 1121.

The waveguide filter 1100 additionally differs in structure from the waveguide filter 100 in that the waveguide filter 1100 additionally comprises a second indirect, alternative, or cross-coupling RF signal transmission means 1700 for transmitting the RF signal from the resonator 1114 on the monoblock 1101 to the resonator 1122 on the monoblock 1122.

In the embodiment of FIGS. 3 and 4, the indirect or cross-coupling RF signal transmission means 1700 includes respective RF signal transmission interior or Internal windows or regions or apertures of dielectric material 1722 (i.e, regions devoid of conductive material) defined on the respective exterior side surfaces 1106 and 1108 of the respective monoblocks 1101 and 1103 in the regions of and between the respective resonators 1114 and 1122 and, more specifically, in the region of the respective exterior surfaces 1106 and 1108 located between the vertical end wall 1142 of the respective steps 1136 and 1138 and the respective first pair of slots 124 and 126 located between the respective resonators 1114 and 1116 and the resonators 1122 and 1121. The respective windows 1722 are adapted to be abutted against each other to define the interior or internal indirect or cross-coupling RF signal transmission means 1700 and interior or internal indirect or cross-coupling path for the transmission of the RF signal from the resonator 1114 into the resonator 1122.

Thus, the assembled or finished waveguide filter 1100 as shown in FIG. 3 comprises a block 1105 of dielectric material defined by the two monoblocks 1101 and 1103 and defining a central longitudinal axis $L_2$; a pair of opposed and spaced-apart top and bottom horizontal exterior surfaces 1102 and 1104 extending in the same direction as the longitudinal axis $L_2$; a pair of opposed and spaced-apart vertical exterior surfaces 1106 and 1108 extending in the same direction as the longitudinal axis $L_2$; and a pair of opposed and spaced-apart vertical exterior end surfaces 1110 and 1112 extending in a direction transverse to the longitudinal axis $L_2$.

The finished waveguide filter 1100 further comprises an elongate end step or notch 1137 defined in the block 1105 of dielectric material in a region thereof adjoining the transverse end surface 1104 thereof and extending in a direction normal to the longitudinal axis $L_2$ of the block 1105 between the side surface 1106 and the side surface 1108. The step 1137, which has the same structure and features as the steps 1136 and 1138 which in combination define the step 1137, includes a horizontal surface 1140 which is spaced from and generally parallel to the exterior surface 1102 of the block 1105 of the waveguide filter 1100 and a vertical end wall 1142 spaced from and parallel to the block and vertical surface 1110.

The finished waveguide filter 1100 still further comprises the pair of RF signal input/outputs or electrodes defined in part by the pair of RF signal input/output through-holes 1146, the above description of which is incorporated herein by reference, which extend through the body and dielectric material of the block 1105 in a relationship and direction generally normal to the longitudinal axis $L_2$ and terminating in respective openings in the step surface 1140 and the block surface 1104 respectively. As shown in FIG. 4, the first of the pair of through-holes 1146 is located and defined in the step 1137 in a region thereof located above the longitudinal axis $L_2$ and spaced from the end surface 1104, while the second of the pair of through-holes 1146 is located and defined in the step 1137 in a region thereof located below the longitudinal axis $L_2$, spaced from the end surface 1104, and co-linear with the first one of the pair of through-holes 1146.

The waveguide filter 1100 still further comprises the pair of SMA RF signal input/output co-axial connectors 1400 and 1401, the above description of which is incorporated herein by reference, which are seated on the surface 1140 of the step 1137 in a spaced-apart and co-linear relationship and coupled to the RF signal input/output through-holes 1146 respectively.

The waveguide filter 1100 still further comprises and defines the pair of spaced-apart and generally parallel elongate slots 1124, the above description of which is incorporated herein by reference, extending from the side surface 1106 of the block 1105 into the body and dielectric material of the block 1105 in a relationship generally normal to both the side surface 1106 and the longitudinal axis $L_2$ of the block 1105, and the pair of spaced-apart and parallel elongate slots 1126, the above description of which is also incorporated herein by reference, extending from the side surface 1108 of the block 1105 into the body and dielectric material of the block 1105 in a relationship generally normal to both the side surface 1108 and the longitudinal axis $L_2$ of the block 1105 and further in a relationship co-linear with, and spaced from, the respective slots 1124. The slots 1124 and 1126 extend between and through the top and bottom exterior surfaces 1102 and 1104 and the respective side surfaces 1106 and 1108 of the block 1105 of the waveguide filter 1100.

The waveguide filter 1100 still further comprises and defines the pair of generally oval-shaped and centrally located elongate, spaced-apart, parallel, and interior slots 1129 and 1131, the above description of which is incorporated herein by reference, which extend through the body and dielectric material of the block 1105 in a relationship normal to and intersecting the longitudinal axis $L_2$ of the block 1105 and terminate in respective generally oval-shaped openings in the top and bottom exterior surfaces 1102 and 1104 of the block 1105 of the waveguide filter 1100.

The slot 1129 is located in the block 1105 of the waveguide filter 1100 in a relationship co-linear with, between, and spaced from one of the pairs of slots 1124 and 1126, while the slot 1131 is located in the block 1105 of the waveguide filter 1100 in a relationship spaced from and generally parallel to the slot 1129 and co-linear with, between, and spaced from the other of the pairs of slots 1124 and 1126.

In the embodiment of FIGS. 3 and 4, the cross-coupling RF signal transmission means 1500 is located between, spaced from, and parallel to the slots 1129 and 1131.

In the embodiment of FIGS. 3 and 4, all of the exterior surfaces 1102, 1104, 1106, 1108, 1110, 1112; the interior surface of each of the slots 1124, 1126, 1129, and 1131; and the Interior surface of each of the RF signal input/output through-holes 1146 are covered with a layer of conductive material, with the exception of the region (not shown) but identical to the region 151 as described above surrounding the opening defined in the surface 1140 of the step 1137 by the respective RF signal input/output through-holes 1146.

Additionally, in the embodiment of FIGS. 3 and 4, a central interior layer or wall 1109 of conductive material extends vertically through the full length and height of the body of the block 1105 of the waveguide filter 1100 in a relationship co-linear and co-planar with the longitudinal axis $L_2$ of the block 1105 of the waveguide filter 1100, with the exception of the interior or Internal windows or regions 1622 and 1722 of dielectric material defined in the layer 1109 as described in more detail above which are devoid of conductive material.

The combination of the block 1105 of dielectric material; the slots 1124, 1126, 1129, and 1131; and the conductive material covering the same as described in more detail above define and create the two rows and columns of RF signal resonators 1114, 1116, 1118, 1120, 1121, and 1122 and connecting RF signal bridges of dielectric material 1128, 1130, 1132, and 1134 in the block 1105 of the waveguide filter 1100 as depicted in FIGS. 3 and 4 in which the resonators 1114 and 1122, 1116 and 1121, and 1118 and 1120 are disposed in a side-by-side relationship and are electrically separated from each other by the central interior layer or wall 1109 of dielectric material except in the regions thereof including the windows 1622 and 1722 and the RF signal transmission means 1500.

In accordance with the invention, and in the same manner as the waveguide filter 100 described above and thus incorporated herein by reference, the waveguide filter 1100 defines a first magnetic or inductive generally U-shaped direct coupling RF signal transmission path for RF signals generally designated by the arrows d in FIG. 3 successively through the connector 1400 in the embodiment where the connector 1400 defines the RF signal input connector; the RF signal transmission input through-hole 1146 in the step 1137; the step 1137 on the block 1105 and, more specifically, the step 1136 on the resonator 1114 of the monoblock 1101; the resonator 1114 in the block 1105 and, more specifically, the resonator 1114 in the monoblock 1101; the resonator 1116 in the block 1105 and, more specifically, the resonator 1116 in the monoblock 1101 via and through the RF signal bridge 1128; and the resonator 1118 in the block 1105 and, more specifically, the resonator 1118 in the monoblock 1101 via and through the RF signal bridge 1130.

Thereafter, the RF signal is transmitted into the resonator 1120 of the block 1105 and, more specifically, into the resonator 1120 of the monoblock 1103 via the direct coupling RF signal transmission means 1600 defined by the interior RF signal transmission window 1622 defined in the interior of the block 1105 by the interior layer or wall 1109 of conductive material and between the resonators 1118 and 1120; the resonator 1121 in the block 1105 and, more specifically, in the resonator 1121 in the monoblock 1103 via and through the RF signal bridge 1132; the resonator 1122 in the block 1105 and, more specifically, the resonator 1122 in the monoblock 1102 via and through the RF signal bridge 1134; the RF signal transmission output through-hole 1146 also located in the step 1137 and, more specifically, in the step 1138 defined in the end of the resonator 1122 of the monoblock 1103; back into the step 1137 and, more specifically, the step 1138 at the end of the resonator 1121 of monoblock 1103; and out through the RF signal output connector 1401 seated on the step 1137 and, more specifically, seated on the step 1138 in the monoblock 1103.

In accordance with this embodiment of the present invention, the waveguide filter 1100 also defines and provides a pair of alternate or Indirect- or cross-coupling RF signal transmission paths for RF signals generally designated by the arrows c in FIG. 3.

One of the cross-coupling or indirect electrical field/capacitive RF signal transmission paths c is defined and created by the external RF signal transmission line 1500 which allows for the transmission of a small portion of the direct RF signal being transmitted through the resonator 1116 of the block 1105, and more specifically, the resonator 1116 of the monoblock 1101, to be transmitted directly into the resonator 1121 of the block 1105, and more specifically the resonator 1121 of the monoblock 1103, via the external strip of conductive material 1504 which bridges and electrically interconnects the respective resonators 1116 and 1121 on the block 1105, and more specifically the resonators 1116 and 1121 on the respective monoblocks 1101 and 1103.

The other cross-coupling or indirect magnetic/inductive RF signal transmission path c is defined and created by the interior or internal RF signal transmission means 1700 which allows for the transmission of a small portion of the direct RF signal being transmitted through the resonator 1114 of the block 1105, and more specifically the resonator 1114 of the monoblock 1101, to be transmitted directly into the resonator 1122 of the block 1105, and more specifically the resonator 1122 of the monoblock 1103, via and through the interior or internal RF signal transmission window 1722 defined in the interior of the block 1105 between the resonators 1114 and 1122.

In accordance with the invention, the cross-coupling of the RF signal as described above advantageously creates respective first and second pairs of transmission zeros, the first pair of which will be located below the passband of the waveguide filter 1100 and the second pair of which will be located above the passband of the waveguide filter 1100 as shown in FIG. 12 which is a graph of the performance/frequency response of the waveguide filter 1100 shown in FIG. 3 in which Attenuation (measured in dB) is shown along the vertical axis and Frequency (measured in MHz) is shown along the horizontal axis.

Still further, in accordance with the embodiment of the invention shown in FIG. 3, the internal RF signal transmission window 1622 is designed/sized to create an inductive direct RF signal coupling stronger than the indirect- or cross-capacitive coupling created and defined by the external RF transmission line 1500 extending between and interconnecting the respective resonators 1116 and 1121 which, in turn, is designed/sized to create an indirect cross-coupling stronger than the indirect, cross-coupling created and defined by the internal RF transmission window 1722 between and interconnecting the respective resonators 1114 and 1122.

Third Embodiment

Figures 5, 6:
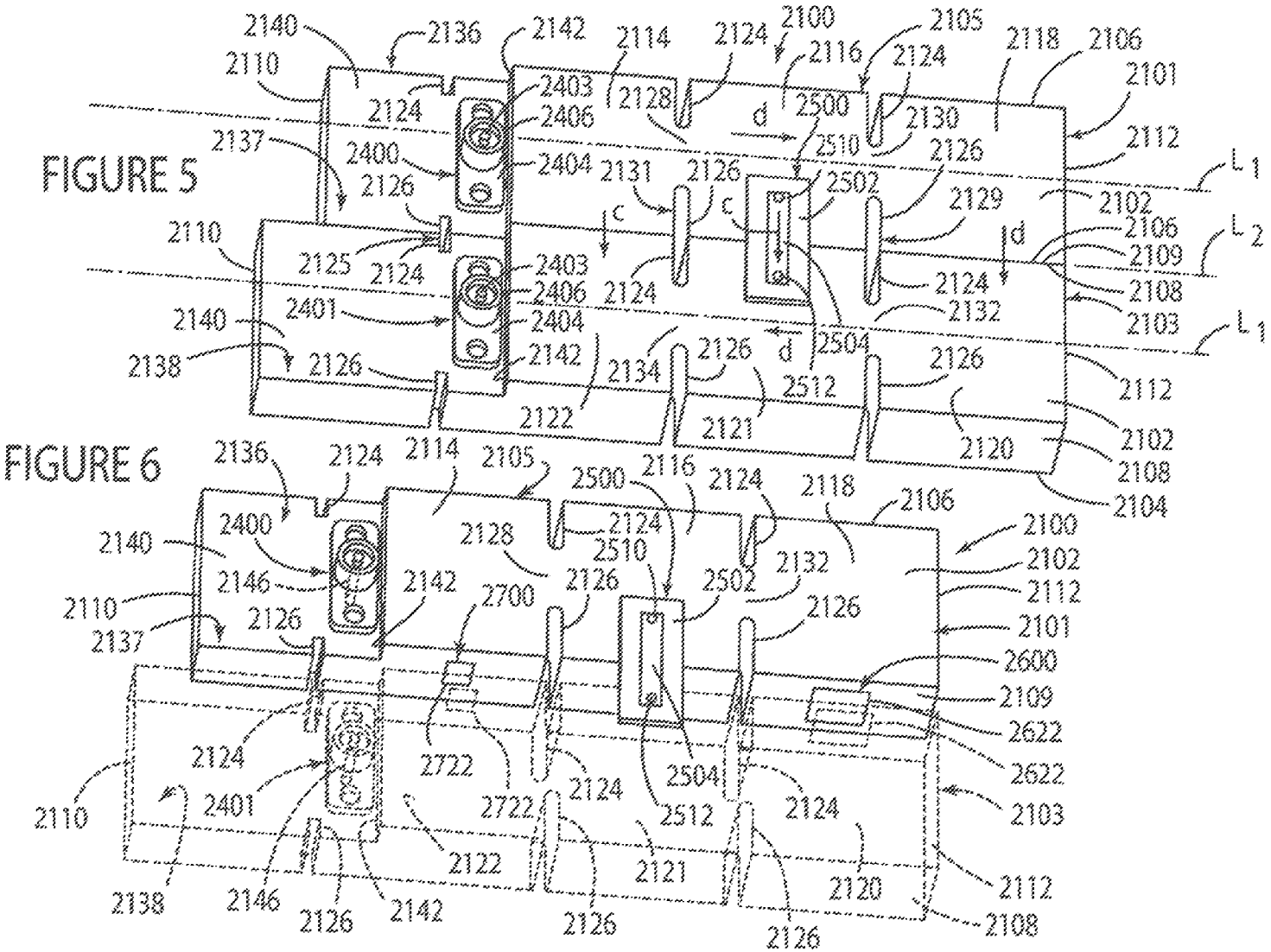
FIG. 5 is an enlarged perspective view of yet another embodiment of a dielectric waveguide filter in accordance with the present invention.
FIG. 6 is an enlarged, part exploded, part phantom perspective view of the dielectric waveguide filter shown in FIG. 5.

FIGS. 5 and 6 depict yet another embodiment of a waveguide filter 2100 in accordance with the present invention which includes all of the elements and features of the waveguide filters 100 and 1100 except that the waveguide filter 2100 includes a step 2137 and, more specifically, steps 2136 and 2138 of varying length and defining shunt zeros as described in more detail below.

Thus, and as described above with respect to the waveguide filters 100 and 1100 and thus incorporated herein by reference, the waveguide filter 2100 is, in the embodiment shown, made from a pair of separate generally parallelepiped-shaped monoblocks 2101 and 2103 which have been coupled and secured together to form the waveguide filter assembly 2100 as described in more detail below.

Each of the monoblocks 2101 and 2103 is comprised of a suitable dielectric material, such as for example ceramic; defines a longitudinal axis $L_1$; includes opposed and spaced-apart longitudinal horizontal exterior surfaces 2102 and 2104 extending longitudinally in the same direction as the longitudinal axis $L_1$; opposed and spaced-apart longitudinal side vertical exterior surfaces 2106 and 2108 extending longitudinally in the same direction as the longitudinal axis $L_1$; and opposed transverse side vertical exterior and spaced-apart end surfaces 2110 and 2112 extending in a direction generally normal to the longitudinal axis $L_1$ of each of the monoblocks 2101 and 2103.

Each of the monoblocks 2101 and 2103 include respective pluralities of resonant sections (also referred to as cavities or cells or resonators) 2114, 2116, and 2118 and 2120, 2121, and 2122 which are respectively arranged in columns and spaced longitudinally along the length and longitudinal axis $L_1$ of the respective monoblocks 2101 and 2103 and are separated from each other by a plurality of (and more specifically two in the embodiment of FIG. 5) spaced-apart vertical slits or slots 2124 and 2126 which are cut into the surfaces 2102, 2104, 2106, and 2108 of each of the monoblocks 2101 and 2103 and interconnected together by RF signal bridges 2128, 2130, 2132, and 2134 as described in more detail below.

The two slots 2124 extend along the length of the side surface 2106 of each of the monoblocks 2101 and 2103 in a spaced-apart and parallel relationship and in a relationship generally normal to the longitudinal axis $L_1$. Each of the slots 2124 cuts through the side surface 2106 and the opposed horizontal surfaces 2102 and 2104 and partially through the body and the dielectric material of each of the monoblocks 2101 and 2103.

The two slots 2126 extend along the length of the opposed side surface 2108 of each of the monoblocks 2101 and 2103 in a spaced-apart and parallel relationship, in a relationship generally normal to the longitudinal axis $L_1$, and in a relationship opposed, co-linear, and co-planar with the respective slots 2124 defined in the side surface 2106. Each of the slots 2126 cuts through the side surface 2108 and the opposed horizontal surfaces 2102 and 2104 and partially through the body and the dielectric material of each of the monoblocks 2101 and 2103.

By virtue of their opposed, spaced, co-linear, and co-planar relationship, each of the pair of slots 2124 and 2126 together define a plurality of (and more specifically two in the embodiment of FIG. 5) generally centrally located RF signal bridges 2128 and 2130 which extend between and interconnect the respective resonators 2114, 2116, and 2118 in the monoblock 2101, and RF signal bridges 2132 and 2134 which extend between and interconnect the respective resonators 2120, 2121, and 2122 and are each comprised of a bridge or island of dielectric material which extends between the surfaces 2102 and 2104 of each of the monoblocks 2101 and 2103 in a relationship and orientation generally normal to and intersecting the longitudinal axis $L_1$ of each of the respective monoblocks 2101 and 2103.

Specifically, the bridge 2128 of dielectric material on the monoblock 2101 bridges and Interconnects the dielectric material of the resonator 2114 to the dielectric material of the resonator 2116, while the bridge 2130 of dielectric material bridges and interconnects the dielectric material of the resonator 2116 to the dielectric material of the resonator 2118. In a similar manner, the bridge 2132 of dielectric material on the monoblock 2103 bridges and interconnects the dielectric material of the resonator 2120 to the dielectric material of the resonator 2121, while the bridge 2134 of dielectric material bridges and interconnects the dielectric material of the resonator 2121 to the dielectric material of the resonator 2122.

In the embodiment shown, the width of each of the RF signal bridges 2128, 2130, 2132, and 2134 is dependent upon the distance between the opposed slots 2124 and 2126 and, in the embodiment shown, is approximately one-third the width of each of the monoblocks 2101 and 2103.

Although not shown in any of the FIGURES, it is understood that the thickness or width of the slots 2124 and 2126 and the depth or distance which the slots 2124 and 2126 extend from the respective one of the side surfaces 2106 or 2108 into the body and dielectric material of each of the monoblocks 2101 and 2103 may be varied depending upon the particular application to allow the width and the length of the RF signal bridges 2128 and 2130 to be varied accordingly to allow control of the electrical coupling and bandwidth of the waveguide filter assembly 2100 and hence control the performance characteristics of the waveguide filter assembly 2100.

The monoblocks 2101 and 2103 additionally comprise and define respective end steps or notches 2136 and 2138 each comprising, in the embodiment shown, a generally L-shaped recessed or grooved or shouldered or notched region or section of the longitudinal surface 2104, opposed side surfaces 2106 and 2108, and opposed side end surfaces 2110 and 2112 of the monoblock 2101 from which dielectric ceramic material has been removed or is absent.

Stated another way, the respective steps 2136 and 2138 are defined in and by respective end sections or regions of the respective monoblocks 2101 and 2103, and more specifically the respective end resonators 2114 and 2122, having a height less than the height of the remainder of the respective monoblocks 2101 and 2103.

Stated yet another way, the respective steps 2136 and 2138 each comprise a generally L-shaped recessed or notched portion of the respective end resonators 2114 and 2122 defined on the respective monoblocks 2101 and 2103 which includes a first generally horizontal surface 2140 located or directed inwardly of, spaced from, and parallel to the surface 2104 of the respective monoblocks 2101 and 2103 and a second generally vertical surface or wall 2142 located or directed inwardly of, spaced from, and parallel to, the respective side end surfaces 2110 and 2112 of the respective monoblocks 2101 and 2103.

The steps 2136 and 2138 of the waveguide filter 2100 however differ in structure from the steps 136 and 138 of the waveguide filter 100 in that the steps 2136 and 2138 are longer than the steps of the respective waveguide filters 100 and 1100 and further in that, in the embodiment shown, the step 2138 is longer than the step 2136.

As shown in FIGS. 5 and 6, the waveguide filter 2100 also differs in structure from the waveguide filters 100 and 1100 in that the monoblocks 2101 and 2103 additionally define one additional pair of co-linearly aligned and opposed slots 2124 and 2126 defined in the respective surfaces 2106 and 2108 of the respective monoblocks 2101 and 2103 and located and defined in each of the respective steps 2136 and 2138 in a relationship normal to the longitudinal axis $L_1$ of the respective monoblocks 2101 and 2103 and spaced from the vertical wall 2140 defining the respective steps 2136 and 2138 and further in a relationship wherein the respective connectors 2400 and 2401 are seated on the respective steps 2136 and 2138 between the respective pairs of slots 2124 and 2126 and the vertical wall 2140 of the respective steps 2136 and 2138.

The monoblocks 2101 and 2103 additionally each comprise an electrical RF signal input/output electrode in the form of respective through-holes 2146 (FIG. 6) extending through the body of the respective monoblocks 2101 and 2103 in a relationship generally normal to the longitudinal axis $L_1$ thereof and, more specifically, through the respective steps 2136 and 2138 thereof and, still more specifically, through the body of the respective end resonators 2114 and 2122 defined in the respective monoblocks 2101 and 2103 between, and in relationship generally normal to, the surface 2140 of the respective steps 2136 and 2138 and the surface 2104 of the respective monoblocks 2101 and 2103.

Still more specifically, the respective input/output through-holes 2146 are spaced from and generally parallel to the respective transverse side end surface 2110 of the respective monoblocks 2101 and 2103 and define respective generally circular openings (not shown) located and terminating in the step surface 2140 and the monoblock surface 2104 respectively.

The RF signal input/output through-holes 2146 are located and positioned in and extend through the interior of the respective monoblocks 2101 and 2103 and the respective steps 2136 and 2138 in the region of the steps 2136 and 2138 located between and in a relationship generally spaced from and parallel to, the additional pair of slots 2124 and 2126 and the step wall or surface 2142 and further in a direction generally normal to and intersecting the longitudinal axis $L_1$.

All of the external surfaces 2102, 2104, 2106, 2108, 2110, and 2112 of the monoblock 2101, the internal surfaces of the respective slots 2124 and 2126, and the internal surfaces of the input/output through-holes 2146 are covered with a suitable conductive material, such as for example silver, with the exception of the regions described in more detail below including a region (not shown) identical to the region 151 shown in FIG. 1 and described above in detail.

The monoblocks 2101 and 2103 still further comprise respective SMA RF signal input/output co-axial connectors 2400 and 2401 which have been seated on the respective steps 2136 and 2138 as describe above and which each include a generally rectangularly-shaped connector base plate or flange 2404, a generally cylindrically-shaped connector housing or shell 2406 extending generally normally unitarily upwardly and outwardly from the top surface of the flange 2404, and an elongated center connector pin 2403 extending through both the interior of the shell 2406 and the body of the flange 2404.

The respective connectors 2400 and 2401 are seated against the respective steps 2136 and 2138 of the respective monoblocks 2101 and 2103 in a relationship generally normal to the side surfaces 2106 and 2108 of the respective monoblocks 2101 and 2103 wherein the base plate 2404 of the respective connectors 2400 and 2401 is seated against the surface 2140 of the respective steps 2136 and 2138 and the shell 2406 is co-axially aligned with the respective through-holes 2146 defined in the respective steps 2136 and 2138.

The connector flange 2404 is directly soldered to the surface 2140 of the respective steps 2136 and 2138 of the respective monoblocks 2101 and 2103 and the connector pin 2403 extends into and is reflow-soldered to the conductive material in the interior of the respective through-holes 2146.

In the embodiment shown, the respective connectors 2400 and 2401 are seated on the respective portions of the respective steps 2136 and 2138 located between the respective additional pairs of slots 2124 and 2126 and the vertical end surface 2142 of the respective steps 2136 and 2128 in a direction and relationship generally normal and intersecting the longitudinal axis $L_1$.

As shown in FIG. 5, the separate monoblocks 2101 and 2103 are coupled and secured to each other to define and form the waveguide filter 2100 as described in more detail below in which the plurality of resonators 2114, 2116, 2118, 2120, 2121, and 2122 are arranged in one or more rows and columns and, more specifically, in the embodiment shown, in which the plurality of resonators 2114, 2116, 2118, 2120, 2121, and 2122 are arranged in a two column and three row pattern.

Specifically, and as shown in FIG. 5, the monoblocks 2101 and 2103 are coupled and secured together to define the waveguide filter 2100 in a relationship wherein the vertical side surface 2108 of the monoblock 2101 is abutted against the vertical side surface 2106 of the monoblock 2103; the slots 2126 on the monoblock 2101 are co-linearly aligned with the slots 2124 on the monoblock 2103 to define a pair of respective elongate, spaced-apart and parallel internal and elongate interior slots 2129 and 2131 located in the center of the waveguide filter 2100 in a relationship generally normal to the longitudinal axis $L_1$ of the monoblocks 2101 and 2103 and in a relationship co-linearly aligned with the exterior and peripheral slots 2124 defined in the surface 2106 of the monoblock 2101 and the slots 2126 defined in the surface 2108 of the monoblock 2103; and the step 2136 on the monoblock 2101 is abutted against and aligned with the step 2138 on the monoblock 2103.

Thus, in the relationship as shown in FIG. 5, the resonators 2114, 2116, and 2118 on the monoblock 2101 are arranged in a first column; the resonators 2120, 2121, and 2122 on the monoblock 2103 are arranged in an abutting second column; respective resonators 2114 and 2122 on the respective monoblocks 2101 and 2103 are disposed in an abutting, side-by-side and row relationship; the respective resonators 2116 and 2121 on the respective monoblocks 2101 and 2103 are disposed in an abutting, side-by-side and row relationship; and the respective resonators 2118 and 2120 on the respective monoblocks 2101 and 2103 are disposed in an abutting, side-by-side and row relationship.

The waveguide filter 2100 additionally comprises a first alternate or indirect or cross-coupling RF signal transmission means which, in the embodiment shown, is in the form of a first external, alternate cross-coupling/indirect coupling RF signal transmission electrode or bridge member or line 2500 (identical to the RF signal transmission means 1500 described above and incorporated herein by reference) having a specific impedance and phase and extending between and interconnecting and electrically coupling the respective resonators 2116 and 2121 of the respective monoblocks 2101 and 2103.

In the embodiment shown, the external cross-coupling transmission line 2500 includes and is defined by a generally rectangularly-shaped printed circuit board 2502 which is seated on and bridges the respective top surfaces 2102 of the respective monoblocks 2101 and 2103. The external cross-coupling transmission electrode 2500 additionally includes an elongated strip of conductive material 2504 defined and formed on the top surface of the printed circuit board 2502 which bridges and extends over the respective resonators 2116 and 2121 on the respective monoblocks 2101 and 2103.

Moreover, and although not shown in FIG. 5, it is understood that the printed circuit board 2502 additionally includes and defines respective internal through-holes extending through the body of the printed circuit board 2502 and adapted to receive respective conductive posts 2510 and 2512 extending outwardly from the respective top surfaces 2102 of the respective resonators 2116 and 2121 of the respective monoblocks 2102 and 2103 into contact with opposed end sections of the elongate strip of conductive material 2504 for electrically coupling the resonators 2116 and 2121.

The waveguide filter 2100 further comprises a direct coupling RF signal transmission means 2600 (identical to the RF signal transmission means 600 and 1000 described above and incorporated herein by reference) for directly interconnecting and coupling, and defining a direct RF signal transmission path between the respective resonators 2118 and 2120 on the respective monoblocks 2101 and 2103.

In the embodiment of FIGS. 5 and 6, the direct RF signal transmission means 2600 includes respective RF signal interior or internal transmission windows or regions or apertures 2622 of dielectric material (i.e, regions devoid of conductive material) defined on the respective exterior side surfaces 2106 and 2108 of the respective monoblocks 2101 and 2103 in the region of and between the resonators 2118 and 2120 which are abutted against each other to define the interior or internal path or window for the transmission of the RF signal from the resonator 2118 to the resonator 2120.

The waveguide filter 2100 still further comprises a second alternate, cross-coupling/indirect coupling RF signal transmission means 2700 (identical in structure to the RF signal transmission means 1700 described above and incorporated herein by reference) for interconnecting the respective resonators 2114 and 2122 of the respective monoblocks 2101 and 2103.

In the embodiment of FIG. 5, the indirect or cross-coupling RF signal transmission means 2700 includes respective interior or internal RF signal transmission windows or regions or apertures 2722 devoid of conductive material (i.e, regions of dielectric material) defined on the respective exterior side surfaces 2106 and 2108 of the respective monoblocks 2101 and 2103 in the region of and between the respective resonators 2114 and 2122 and, more specifically, in the region of the respective exterior surfaces 2106 and 2108 located between the vertical end wall 2142 of the respective steps 2136 and 2138 and the respective first pair of slots 2124 and 2126 located between the respective resonators 2114 and 2116 and the resonators 2122 and 2121. The respective windows 2722 are adapted to be abutted against each other to define the interior or internal indirect or cross-coupling RF signal transmission means and interior or internal indirect or cross-coupling path for the transmission of the RF signal from the resonator 2114 into the resonator 2122.

Thus, the assembled or finished waveguide filter 2100 as shown in FIGS. 5 and 6 comprises a block 2105 of dielectric material defining a central longitudinal axis $L_2$; a pair of opposed and spaced-apart top and bottom horizontal exterior surfaces 2102 and 2104 extending in the same direction as the longitudinal axis $L_2$; and a pair of opposed and spaced-apart vertical exterior surfaces 2106 and 2108 extending in the same direction as the longitudinal axis $L_2$; a pair of opposed and spaced-apart vertical exterior end surfaces 2110 and 2112 extending in a direction transverse to the longitudinal axis $L_2$.

The finished waveguide filter 2100 further comprises an elongate end step or notch 2137 defined in the block 2105 of dielectric material in a region thereof adjoining the transverse end surface 2104 thereof and extending in a direction normal to the longitudinal axis $L_2$ of the block 2105 between the side surface 2106 and the side surface 2108. The step 2137 includes a horizontal surface 2140 which is spaced from and generally parallel to the exterior surface 2102 of the block of the waveguide filter 2100 and a vertical end wall 2142 spaced from and generally parallel to the block end vertical surface 2110.

In the embodiment shown, the step 2137 includes and is defines by the combination of the step 2138 of the monoblock 2103 which is located below the longitudinal axis $L_2$ and the step 2136 of the monoblock 2101 which is located above the longitudinal axis $L_2$ and is shorter than the step 2138.

The waveguide filter 2100 still further comprises the pair of RF signal input/outputs defined in part by the respective RF signal input/output through-holes 2146, the above description of which is incorporated herein by reference, which are defined in and extend through the body and dielectric material of the block 2105 in a relationship and direction generally normal to the longitudinal axis $L_2$. As shown in FIG. 6, one of the through-holes 2146 is located and defined in the step 2137 in a region thereof located above the longitudinal axis $L_2$ and spaced from the end surface 2104, while the other of the through-holes 2146 is located and defined in the step 2137 in a region thereof located below the longitudinal axis $L_2$, spaced from the end surface 2104, and co-linear with the one of the through-holes 2146.

The waveguide filter 2100 still further comprises the pair of SMA RF signal input/output connectors 2400 and 2401, the above description of which is incorporated herein by reference, which are seated on the surface 2140 of the step 2137 in a spaced-apart and co-linear relationship and coupled to the RF signal input/output through-holes 2146 respectively and in a relationship normal to the longitudinal axis $L_2$.

In the embodiment shown, the connector 2400 is seated on the portion of the step 2137 located above the longitudinal axis $L_2$ and the connector 2401 is seated on the portion of the step 2137 located below the longitudinal axis $L_2$.

The waveguide filter 2100 still further comprises and defines the three spaced-apart and generally parallel elongate slots 2124 extending from the side surface 2106 of the block 2105 into the body and dielectric material of the block 2105 in a relationship generally normal to both the side surface 2106 and the longitudinal axis $L_2$ of the block 2105, and the three separate spaced-apart and parallel elongate slots 2126 extending from the side surface 2108 of the block 2105 into the body and dielectric material of the block 2105 in a relationship generally normal to both the side surface 2108 and the longitudinal axis $L_2$ of the block 2105 and further in a relationship co-linear with the respective slots 2124, so as to define the three pairs of opposed and co-linear slots 2124 and 2126. The slots 2124 and 2126 extend between and through the top and bottom exterior surfaces 2102 and 2104 and the respective side surfaces 2106 and 2108 of the block of the waveguide filter 2100.

In the embodiment shown, one of the pairs of co-linear and opposed slots 2124 and 2126 is located and defined in the step 2137 in a relationship spaced from and parallel to the vertical end wall 2142 of the step 2137.

The waveguide filter 2100 still further comprises and defines three generally oval-shaped and centrally located elongate, spaced-apart, parallel, and interior slots 2125, 2129, and 2131 which extend through the body and dielectric material of the block 2105 and terminate in respective generally oval-shaped openings in the top and bottom exterior surfaces 2102 and 2104 of the block 2105 of the waveguide filter 2100.

The slot 2129 is located in the block 2105 of the waveguide filter 2100 in a relationship co-linear with and spaced from one of the pairs of slots 2124 and 2126, while the slot 2131 is located in the block 2105 of the waveguide filter 2100 in a relationship spaced from and generally parallel to the slot 2129 and co-linear with and spaced from the other of the pairs of slots 2124 and 2126. The slot 2125 is located in the step 2137 of the block 2105 of the waveguide filter 2100 in a relationship co-linear and spaced from the pair of slots 2124 and 2126 defined in the step 2137.

Further, the slots 2125, 2129, and 2131 are located in the block 2105 of the waveguide filter 2100 in a relationship generally normal to and Intersecting the longitudinal axis $L_2$ of the block 2105 of the waveguide fitter 2100.

Thus, in the embodiment of FIGS. 5 and 6, the RF signal input/output through-holes 2146 and respective connectors 2400 and 2401 coupled thereto are located in the region of the step 2137 located between the slots 2124, 2125, and 2126 defined in the step 2137 and the vertical interior wall 2142 of the step 2137.

In the embodiment of FIGS. 5 and 6, all of the exterior surfaces 2102, 2104, 2106, 2108, 2110, 2112; the interior surface of each of the slots 2124, 2126, 2125, 2129, and 2131; and the interior surface of each of the RF signal input/output through-holes 2146 are covered with a layer of conductive material, with the exception of a region (not shown) but similar to the region 151 shown in FIG. 1 surrounding the opening defined in the step surface 2140 by the respective RF signal input/output through-holes 2146.

Additionally, in the embodiment of FIGS. 5 and 6, a central interior vertical layer or wall of conductive material 2109 extends through the full length and height of the body of the block of the waveguide filter 2100 in a relationship co-linear and co-planar with the longitudinal axis $L_2$ of the block 2105 of the waveguide filter 2100, with the exception of the interior or internal windows or regions 2622 and 2722 of dielectric material defined therein as described in more detail above which are devoid of conductive material.

The combination of the block 2105 of dielectric material, the slots 2124, 2126, 2125, 2129, and 2131, and the conductive material covering the same as described in more detail above define and create the two rows of RF signal resonators 2114, 2116, 2118, 2120, 2121, and 2122 and connecting RF signal bridges of dielectric material 2128, 2130, 2132, and 2134 of the waveguide filter 2100 as depicted in FIGS. 5 and 6 in which the resonators 2114 and 2122, 2116 and 2121, and 2118 and 2120 are disposed in a side-by-side relationship and are electrically separated from each other by the central interior layer or wall of dielectric material 2109 except in the regions thereof with the interior or internal windows 2622 and 2722.

The waveguide filter 2100 defines and creates the same direct RF signal path d and indirect cross-coupling RF signal paths c in the same manner as described above with respect to the waveguide filter 1100 and thus the earlier description thereof with respect to the waveguide filter 1100 is incorporated herein by reference with respect to the waveguide filter 2100.

In accordance with the invention, and in the same manner as the waveguide filter 100 described above and thus incorporated herein by reference, the waveguide filter 2100 defines a first magnetic or inductive generally U-shaped direct coupling RF signal transmission path for RF signals generally designated by the arrows d in FIG. 5 successively through the connector 2400 in the embodiment where the connector 2400 defines the RF signal input connector, the RF signal transmission input through-hole 2146 in the step 2137, and more specifically, the step 2136 in the end resonator 2114 of the monoblock 2101; the step 2137 on the block 2105 and, more specifically, the step 2136 on the monoblock 2101; the resonator 2114 in the block 2105 and, more specifically, the resonator 2114 in the monoblock 2101; the resonator 2116 in the block 2105 and, more specifically, the resonator 2116 in the monoblock 2101 via and through the RF signal bridge 2128; and the resonator 2118 in the block 2105 and, more specifically, the resonator 2118 in the monoblock 2101 via and through the RF signal bridge 2130.

Thereafter, the RF signal is transmitted into the resonator 2120 of the block 2105 and, more specifically, into the resonator 2120 of the monoblock 2103 via the RF signal transmission means 2600 defined in the interior of the block 2105 by the interior RF signal transmission window 2622 of dielectric material defined in the interior of the block 2105 in the region of and between the resonators 2118 and 2120 as described above and Incorporated herein by reference; the resonator 2121 in the block 2105 and, more specifically, the resonator 2121 in the monoblock 2103 via and through the RF signal bridge 2132; the resonator 2122 in the block 2105 and, more specifically, the resonator 2122 in the monoblock 2103 via and through the RF signal bridge 2134; the RF signal transmission output through-hole 2146 also located in the step 2137 and, more specifically, located in the step 2138 defined in the end resonator 2122 of the monoblock 2103; back into the step 2137 and, more specifically, the step 2138 defined in the end of the resonator 2121 of the monoblock 2103; and out through the RF signal output connector 2401 seated on the step 2137 and, more specifically, seated on the step 2138 on the monoblock 2103.

In accordance with this embodiment of the present invention, the waveguide filter 2100 also defines and provides a pair of alternate or indirect- or cross-coupling RF signal transmission paths for RF signals generally designated by the arrows c in FIG. 3.

One of the cross-coupling or indirect electrical field/capacitive RF signal transmission paths c is defined and created by the external RF signal transmission line 2500 extending between the resonators 2116 and 2121 as described above and incorporated herein by reference which allows for the transmission of a small portion of the direct RF signal being transmitted through the resonator 2116 of the block 2105, and more specifically the resonator 2116 of the monoblock 2101, to be transmitted directly into the resonator 2121 of the block 2105, and more specifically the resonator 2121 of the monoblock 2103, via the external strip of conductive material 2504 which bridges and electrically interconnects the respective resonators 2116 and 2121 on the block 2105 and, more specifically, on the respective monoblocks 2101 and 2103.

The other cross-coupling or indirect magnetic/inductive RF signal transmission path c is defined and created by the internal RF signal transmission means 2700, as described above and incorporated herein by reference, which allows for the transmission of a small portion of the direct RF signal being transmitted through the resonator 2114 of the block 2105, and more specifically the resonator 2114 of the monoblock 2101, to be transmitted directly into the resonator 2122 of the block 2105, and more specifically the resonator 2122 of the monoblock 2103, via and through the interior or internal RF signal transmission window 2722 defined in the interior of the block 2105 in the region of and between the resonators 2114 and 2122.

In accordance with the invention, the cross-coupling of the RF signal as described above advantageously creates respective first and second pairs of transmission zeros, the first pair of which will be located below the passband of the waveguide filter 2100 and the second pair of which will be located above the passband of the waveguide filter 2100 as shown in FIG. 13 which is a graph of the performance/frequency response of the waveguide filter 2100 shown in FIG. 5 in which Attenuation (measured in dB) is shown along the vertical axis and Frequency (measured in MHz) is shown along the horizontal axis.

Still further, in accordance with the present invention, the internal RF signal transmission window 2622 is designed/sized to create an inductive direct RF signal coupling stronger than the indirect- or cross-capacitive coupling created and defined by the external RF transmission line 2500 extending between and interconnecting the respective resonators 2116 and 2121 which, in turn, is designed/sized to create an indirect cross-coupling stronger than the indirect, cross-coupling created and defined by the internal RF transmission window 2722 between and interconnecting the respective resonators 2114 and 2122.

However, in addition to creating first and second pairs of transmission zeros through the use of the first and second cross-coupling paths as described above and earlier with respect to the waveguide filter 1100, the waveguide filter 2100 provides further improved attenuation characteristics by also creating a first pair of shunt zeros through the use of a step 2137, and more specifically, steps 2136 and 2138 with slots therein and of different length configured as described in detail above and depicted in FIG. 13 which shows not only the pair of transmission zeros above and below the passband of the waveguide filter 2100 but also the additional shunt zero above and below the passband of the waveguide filter 2100.

Fourth Embodiment

Figure 7:
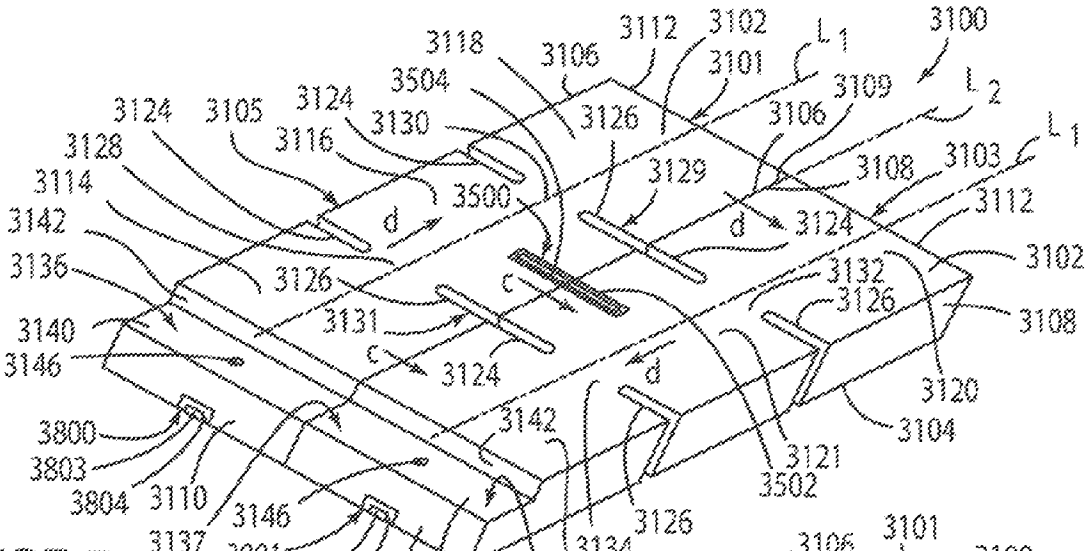
FIG. 7 is an enlarged perspective view of a further embodiment of a dielectric waveguide filter according to the present invention.
Figure 8:
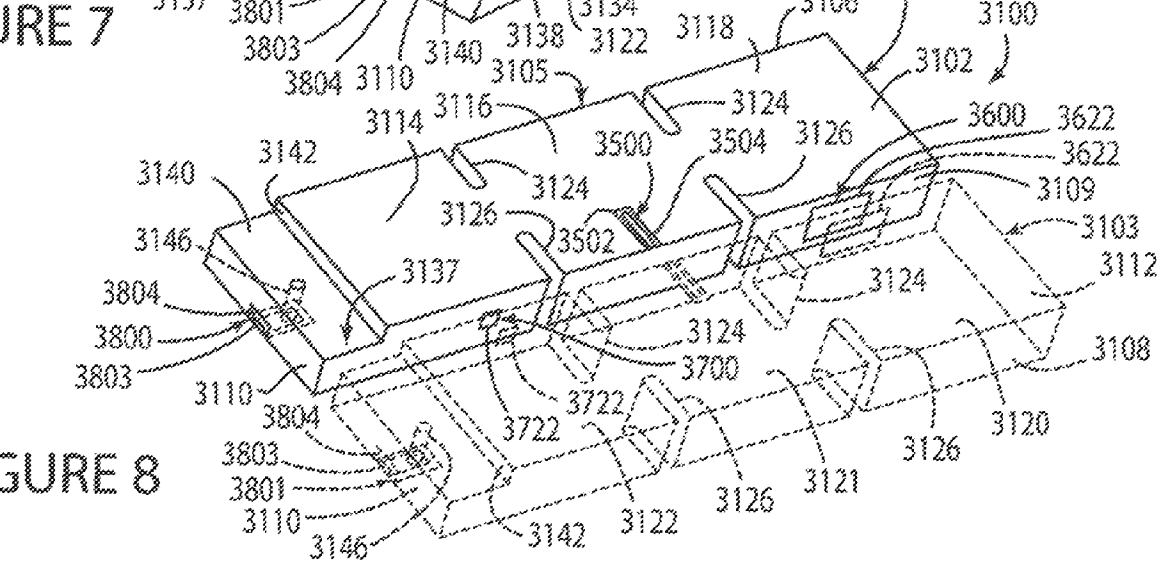
FIG. 8 is an enlarged, part exploded, part phantom perspective view of the waveguide filter shown in FIG. 7.

FIGS. 7 and 8 depict a waveguide filter 3100 which is similar in structure and function to the waveguide filter 1100, and thus the description above with respect to the filter 1100 is incorporated herein by reference, except that the respective steps 3136 and 3138 on the respective monoblocks 3101 and 3103 of the waveguide filter 3100 include respective direct surface mount RF signal input/output pads 3800 and 3802 instead of external connectors 1400 and 1401 as in the waveguide filter 1100 and further includes a differently structured cross-coupling RF signal transmission means or member 3500 as described in more detail below.

Specifically, the waveguide filter assembly 3100, in the embodiment shown, is made from a pair of separate generally parallelepiped-shaped monoblocks 3101 and 3103 which have been coupled and secured together to form the waveguide filter 3100 as described in more detail below.

Each of the monoblocks 3101 and 3103 is comprised of a suitable dielectric material, such as for example ceramic; defines a longitudinal axis $L_1$; opposed and spaced-apart longitudinal horizontal exterior surfaces 3102 and 3104 extending longitudinally in the same direction as the longitudinal axis $L_1$; opposed and spaced-apart longitudinal side vertical exterior surfaces 3106 and 3108 extending longitudinally in the same direction as the longitudinal axis $L_1$; and opposed and spaced-apart transverse side vertical exterior end surfaces 3110 and 3112 extending in a direction generally normal to the longitudinal axis $L_1$ of each of the monoblocks 3101 and 3103.

The monoblocks 3101 and 3103 include respective pluralities of resonant sections (also referred to as cavities or cells or resonators) 3114, 3116, and 3118 and 3120, 3121, and 3122 which are respectively arranged in a column relationship and are spaced longitudinally along the length and longitudinal axis $L_1$ of the respective monoblocks 3101 and 3103 and are separated from each other by a plurality of (and more specifically two in the embodiment of FIG. 7) spaced-apart vertical slits or slots 3124 and 3126 which are cut into the surfaces 3102, 3104, 3106, and 3108 of each of the monoblocks 3101 and 3103.

The two slots 3124 extend along the length of the side surface 3106 of each of the monoblocks 3101 and 3103 in a spaced-apart and parallel relationship and in a relationship generally normal to the longitudinal axis $L_1$. Each of the slots 3124 cuts through the side surface 3106 and the opposed horizontal surfaces 3102 and 3104 and partially through the body of each of the monoblocks 3101 and 3103.

The two slots 3126 extend along the length of the opposed side surface 3108 of each of the monoblocks 3101 and 3103 in a spaced-apart and parallel relationship in a relationship generally normal to the longitudinal axis $L_1$, and in a relationship opposed, co-linear, and co-planar with the respective slots 3124 defined in the side surface 3106. Each of the slots 3126 cuts through the side surface 3108 and the opposed horizontal surfaces 3102 and 3104 and partially through the body and the dielectric material of each of the monoblocks 3101 and 3103.

By virtue of their opposed, spaced, co-linear, and co-planar relationship, each of the pairs of slots 3124 and 3126 together define a plurality of (and more specifically two) generally centrally located RF signal bridges 3128 and 3130 and RF signal bridges 3132 and 3134 in the respective monoblocks 3101 and 3103 which are each comprised of a bridge or island of dielectric material which extends between the surfaces 3102 and 3104 of each of the monoblocks 3101 and 3103 in a relationship and orientation generally normal to and Intersecting the longitudinal axis $L_1$ of each of the respective monoblocks 3101 and 3103 and interconnect the respective resonators 3114, 3116, and 3118 and the resonators 3120, 3121, and 3122.

Specifically, the bridge 3128 bridges and interconnects the dielectric material of the resonator 3114 to the dielectric material of the resonator 3116 while the bridge 3130 of dielectric material bridges and interconnects the dielectric material of the resonator 3116 to the dielectric material of the resonator 3118. In a similar manner, the bridge 3132 of dielectric material on the monoblock 3103 bridges and interconnects the dielectric material of the resonator 3120 to the dielectric material of the resonator 3121 while the bridge 3134 of dielectric material bridges and interconnects the dielectric material of the resonator 3121 to the dielectric material of the resonator 3122.

In the embodiment shown, the width of each of the RF signal bridges 3128, 3130, 3132, and 3134 is dependent upon the distance between the opposed slots 3124 and 3126 and, in the embodiment shown, is approximately one-third the width of each of the monoblocks 3101 and 3103.

The monoblocks 3101 and 3103 additionally comprise and define respective end steps or notches 3136 and 3138 which are identical in structure and function to the respective steps or notches 136 and 138 in the waveguide filter 100 and the respective steps or notches 1136 and 1138 in the waveguide filter 1100, and thus the earlier description of the features and structure of the notches 136 and 138 and the steps 1136 and 1138 is incorporated herein by reference with respect to the steps 3136 and 3138.

Thus, in the embodiment shown, each of the steps or notches 3136 and 3138 comprises a generally L-shaped recessed or grooved or shouldered or notched region or section of the longitudinal surface 3104, opposed side surfaces 3106 and 3108, and opposed side end surfaces 3110 and 3112 of the monoblocks 3101 and 3103, and more specifically the respective end resonators 3114 and 3123 thereof, from which dielectric ceramic material has been removed or is absent. The steps 3136 and 3138 extend in a direction normal to, and intersecting the longitudinal axis $L_1$ of the respective monoblocks 3101 and 3103.

The monoblocks 3101 and 3103 additionally each comprise an electrical RF signal input/output electrode in the form of through-holes 3146 as shown in FIG. 8 which extend through the body of the respective monoblocks 3101 and 3103 and, more specifically, through the respective steps 3136 and 3138 thereof and, still more specifically, through the body of the respective end resonators 3114 and 3122 defined in the respective monoblocks 3101 and 3103 between, and in relationship generally normal to, the surface 3140 of the respective steps 3136 and 3138 and the surface 3104 of the respective monoblocks 3101 and 3103.

Still more specifically, the respective input/output through-holes 3146 are spaced from and generally parallel to the respective transverse side end surface 3110 of the respective monoblocks 3101 and 3103 and define respective generally circular openings (not shown) located and terminating in the step surface 3140 and the monoblock surface 3102 respectively.

The RF signal input/output through-holes 3146 are located and positioned in and extend through the interior and dielectric material of the respective monoblocks 3101 and 3103 in a direction generally normal to and co-linear with the longitudinal axis $L_1$ thereof and the respective steps 3136 and 3138 between and, in a relationship generally spaced from and parallel to, the side end surface 3110 and the step wall or surface 3142.

In lieu of external connectors as in the previous embodiments, the waveguide filter 3100 incorporates respective direct surface mount RF signal input/output pads 3800 and 3802 defined on the bottom surface 3104 of the respective monoblocks 3101 and 3103.

As shown in FIGS. 7 and 8 in which the monoblocks 3101 and 3103 are shown partly in phantom, the RF signal input/output pads 3800 and 3802 each include a strip of conductive material 3803 which includes one end located on the bottom surface 3104 and coupled to the opening defined in the lower surface 3104 of the respective monoblocks 3101 and 3103 by the respective through-holes 3146, wraps around the corner joining the block surfaces 3104 and 3110 and is surrounded by a region 3804 of dielectric material.

In accordance with this embodiment, and although not shown, it is understood that the RF signal input/output pads 3800 and 3802 allow the waveguide filter 3100 to be seated on the surface of a customer's motherboard in a relationship wherein the RF signal input/output pads 3800 and 3802 are coupled to the respective RF signal input/output pads on the customer's motherboard.

All of the external surfaces 3102, 3104, 3106, 3108, 3110, and 3112 of the monoblocks 3101 and 3103, the interior surfaces of the slots 3124 and 3126, and the interior surfaces of the RF signal input/output through-holes 3146 are covered with a suitable conductive material, such as for example silver, with the exception of the regions as discussed above and in more detail below.

As shown in FIG. 7, the separate monoblocks 3101 and 3103 are coupled and secured to each other to define and form the waveguide filter 3100 as described in more detail below in which the plurality of resonators 3114, 3116, 3118, 3120, 3121, and 3122 are arranged in one or more rows and columns and, more specifically, in the embodiment shown, in which the plurality of resonators are arranged in two columns and three rows.

Specifically, and as shown in FIG. 7, the monoblocks 3101 and 3103 are coupled and secured together to define the waveguide filter 3100 in a relationship wherein the vertical side surface 3108 of the monoblock 3101 is abutted against the vertical side surface 3106 of the monoblock 3103; the slots 3126 on the monoblock 3101 are co-linearly aligned with the slots 3124 on the monoblock 3103 to define a pair of respective elongate, spaced-apart, and parallel internal or interior slots 3129 and 3131 located in the center of the waveguide filter 3100 in a relationship generally normal to the longitudinal axis $L_1$ of the monoblocks 3101 and 3103 and in a relationship co-linearly aligned with the slots 3124 defined in the surface 3106 of the monoblock 3101 and the slots 3126 defined in the surface 3108 of the monoblock 3103; and the step 3136 on the monoblock 3101 is abutted against and aligned with the step 3138 of the monoblock 3103.

Thus, in the relationship as shown in FIG. 7, the resonators 3114, 3116, and 3118 on the monoblock 3101 are arranged in a first column; the resonators 3120, 3121, and 3122 on the monoblock 3103 are arranged in an abutting second column; the respective resonators 3114 and 3122 on the respective monoblocks 3101 and 3103 are disposed in an abutting, side-by-side and row relationship; the respective resonators 3116 and 3121 on the respective monoblocks 3101 and 3103 are disposed in an abutting, side-by-side and row relationship; and the respective resonators 3118 and 3120 on the respective monoblocks 3101 and 3103 defining the waveguide filter 3100 are disposed in an abutting, side-by-side and row relationship.

The waveguide filter 3100 additionally comprises a first indirect or cross-coupling, bypass or alternate external RF signal transmission electrode or bridge member or line or means 3500 having a specific impedance and phase and extending between and interconnecting and electrically coupling the respective resonators 3116 and 3121 of the respective monoblocks 3101 and 3103.

The external RF signal transmission line 3500 includes respective strips 3504 of conductive material defined and formed on the top surface 3102 of the respective monoblocks 3101 and 3103 which are surrounded by respective regions 3502 of dielectric material on the top surface 3102 of the respective monoblocks 3101 and 3103.

When the monoblocks 3101 and 3103 are coupled and secured together as described above, the respective strips 3504 are brought into abutting relationship to allow the external transmission of a small portion of the RF signal from the resonator 3116 of the monoblock 3101 directly into the resonator 3121 of the monoblock 3103.

The waveguide filter 3100 still further comprises a direct RF signal transmission means 3600, identical in structure and operation to the RF signal transmission means 600, 1600, and 2600, the above description of which is incorporated herein by reference extending between and interconnecting and coupling the respective resonators 3118 and 3120 on the respective monoblocks 3101 and 3103.

Specifically, the RF signal transmission means 3600 includes respective interior or internal RF signal transmission windows or regions or apertures 3622 which are devoid of conductive material (i.e, regions of dielectric material) defined on the respective exterior side surfaces 3106 and 3108 of the respective monoblocks 3101 and 3103 which are abutted against each other to define an interior or internal direct path for the transmission of the RF signal from the resonator 3118 into the resonator 3120.

The waveguide filter 3100 still further comprises a second cross-coupling/indirect coupling, alternate RF signal transmission means 3700, identical in structure and operation to the RF signal transmission means 1700 and 2700 described above and incorporated herein by reference, extending between and interconnecting the respective resonators 3114 and 3122 of the respective monoblocks 3101 and 3103.

Specifically, the RF signal transmission means 3700 includes respective interior or internal RF signal transmission windows or regions 3722 defined on the respective exterior side surfaces 3106 and 3108 of the respective monoblocks 3101 and 3103 which are abutted against each other to define the alternate or indirect interior or internal path for the interior or internal transmission of the RF signal from the resonator 3114 to the resonator 3122.

Thus, the assembled or finished waveguide filter 3100 as shown in FIG. 7 comprises a block 3105 of dielectric material defining a central longitudinal axis $L_2$; a pair of opposed and spaced-apart top and bottom horizontal exterior surfaces 3102 and 3104 extending in the same direction as the longitudinal axis $L_2$; a pair of opposed and spaced-apart vertical exterior surfaces 3106 and 3108 extending in the same direction as the longitudinal axis $L_2$; and a pair of opposed and spaced-apart vertical exterior end surfaces 3110 and 3112 extending in a direction transverse to the longitudinal axis $L_2$.

The waveguide filter 3100 further comprises an elongate end step or notch 3137 defined in the block 3105 of dielectric material, and more specifically defined by the combination of the respective steps 3136 and 3138 located in the respective end resonators 3114 and 3122 of the respective monoblocks 3101 and 3103, the above description of which is incorporated herein by reference with respect to the step 3137. The step 3137 is formed in a region of the block 3105 adjoining the transverse end surface 3104 thereof and extends in a direction normal to and intersects the longitudinal axis $L_2$ of the block 3105. The step 3105 includes a horizontal surface 3140 which is spaced from and generally parallel to the exterior surface 3102 of the block 3105 of the waveguide filter 3100 and a vertical wall 3142 extending between the top surface 3102 of the block 3105 and the horizontal surface 3140 of the step 3137.

The waveguide filter 3100 still further comprises the pair of RF signal input/outputs defined in part by the respective RF signal input/output through-holes 3146, as described above and incorporated herein by reference, which are defined in and extend through the body and dielectric material of the block 3105 in a relationship and direction generally normal to and spaced from the longitudinal axis $L_2$. As shown in FIG. 7, one of the through-holes 3146 is located and defined in the step 3137, and more specifically the step 3136 on the monoblock 3101, in a region thereof located above and spaced from the longitudinal axis $L_2$ and spaced from the end surface 3104, while the other of the through-holes 3146 is located and defined in the step 3137, and more specifically the step 3138 on the monoblock 3103, in a region thereof located below the longitudinal axis $L_2$, spaced from the end surface 3104 and co-linear with the one of the through-holes 3146.

The waveguide filter 3100 still further comprises the pair of RF signal input/output pads 3800 and 3801, the above description of which is incorporated herein by reference, which are defined on the lower surface 3104 of the block 3105 and the respective resonators 3114 and 3122 on the step 3137 in a spaced-apart and parallel relationship relative to each other and the longitudinal axis $L_2$ and coupled to the RF signal input/output through-holes 3146 respectively.

The waveguide filter 3100 still further comprises and defines the pair of spaced-apart and generally parallel elongate slots 3124 described above in more detail and extending from the side surface 3106 of the block 3105 into the body and dielectric material of the block 3105 in a relationship generally normal to both the side surface 3106 and the longitudinal axis $L_2$ of the block 3105 and the pair of spaced-apart and parallel elongate slots 3126 extending from the side surface 3108 of the block 3105 into the body and dielectric material of the block 3105 in a relationship generally normal to both the side surface 3108 and the longitudinal axis $L_2$ of the block 3105 and further in a relationship opposed and co-linear with the respective slots 3124. The slots 3124 and 3126 extend between and through the top and bottom exterior surfaces 3102 and 3104 and the respective side surfaces 3106 and 3108 of the block 3105 of the waveguide filter 3100.

The waveguide filter 3100 still further comprises and defines the pair of generally oval-shaped and centrally located slots 3129 and 3131 which extend through the body and dielectric material of the block 3105 and terminate in respective generally oval-shaped openings in the top and bottom exterior surfaces 3102 and 3104 of the block 3105 of the waveguide filter 3100.

The slot 3129 is located in the block 3105 of the waveguide filter 3100 in a relationship co-linear with and spaced from one of the pairs of co-linear slots 3124 and 3126, while the slot 3131 is located in the block 3105 of the waveguide filter 3100 in a relationship spaced from and generally parallel to the slot 3129 and co-linear with and spaced from the other of the pairs of co-linear slots 3124 and 3126.

Further, the slots 3129 and 3131 are located in the block 3105 of the waveguide filter 3100 in a relationship generally normal to and intersecting the longitudinal axis $L_2$ of the block 3105 of the waveguide filter 3100.

In the embodiment shown, the RF signal transmission means 3500, as described above and incorporated herein by reference, is located between the two slots 3124 and 3131 in a relationship spaced from and parallel to the slots 3129 and 3131 and normal to and intersecting the longitudinal axis $L_2$.

In the embodiment of FIGS. 7 and 8, all of the exterior surfaces 3102, 3104, 3106, 3108, 3110, 3112; the interior surface of each of the slots 3124, 3126, 3129, and 3131; and the interior surface of each of the RF signal input/output through-holes 3146 are covered with a layer of conductive material, with the exception of the region 3502 surrounding the strip 3504 of conductive material of the RF signal transmission means 3500 and the region 3804 surrounding the strip 3803 of conductive material of each of the RF signal input/output pads 3800 and 3801.

Additionally, in the embodiment of FIGS. 7 and 8, a central interior vertical layer or wall of conductive material 3109 extends through the full length and height of the body of the block of the waveguide filter 3100 in a relationship co-linear and co-planar with the longitudinal axis $L_2$ of the block 3105 of the waveguide filter 3100, with the exception of the interior or internal windows 3822 and 3722 defined in the interior of the block 3105 in the regions of and between the resonators 3118 and 3120 and the resonators 3114 and 3122 respectively as described in more detail above which are internal regions of dielectric material devoid of conductive material.

The combination of the block 3105 of dielectric material, the slots 3124, 3126, 3129, and 3131, and the conductive material covering the same as described in more detail above define and create the two rows of RF signal resonators 3114, 3116, 3118, 3120, 3121, and 3122 and connecting RF signal bridges of dielectric material 3128, 3130, 3132, and 3134 of the waveguide filter 3100 as depicted in FIGS. 7 and 8 in which the resonators 3114 and 3122, 3116 and 3121, and 3118 and 3120 are respectively disposed in a side-by-side relationship and are electrically separated from each other by the central interior layer or wall of dielectric material 3109 with the exception of in the region of the respective interior or internal windows 3622 and 3722 as described in more detail below.

The waveguide filter 3100 defines and creates the same direct RF signal path d and indirect cross-coupling or alternate RF signal paths c in the same manner as described above with respect to the waveguide filter 1100 and 2100, and thus the earlier descriptions thereof are incorporated herein by reference with respect to the waveguide filter 3100.

Specifically, in accordance with the invention, and in the same manner as the waveguide filter 1100 described above and incorporated herein by reference, the waveguide filter 3100 defines a first magnetic or inductive generally U-shaped direct coupling RF signal transmission path for RF signals generally designated by the arrows d in FIG. 7 successively through the RF signal input/output pad 3800 located in the step 3137 of the block 3105 and, more specifically, in the step 3136 of the monoblock 3101 in the embodiment where the RF signal pad 3800 defines the RF signal input pad; the RF signal transmission input through-hole 3146 located in the step 3137, and more specifically, located in the step 3136 defined in the resonator 3114 of the monoblock 3101; the step 3137 on the block 3105 and, more specifically, the step 3136 on the monoblock 3101; the resonator 3114 in the block 3105 and, more specifically, the resonator 3114 of the monoblock 3101; the resonator 3116 in the block 3105 and, more specifically, the resonator 3116 in the monoblock 3101 via and through the RF signal bridge 3128; and the resonator 3118 in the block 3105 and, more specifically, the resonator 3118 in the monoblock 3101 via and through the RF signal bridge 3130.

Thereafter, the RF signal is transmitted into the resonator 3120 of the block 3105 and, more specifically, into the resonator 3120 of the monoblock 3103 via the RF signal transmission means 3600 defined by the interior RF signal transmission window 3622 of dielectric material defined in the interior of the block 3105 in the region of and between the resonators 3118 and 3120, as described above and incorporated herein by reference, by the interior layer or wall 3109 of conductive material; the resonator 3121 in the block 3105 and, more specifically, the resonator 3121 in the monoblock 3103 via and through the RF signal bridge 3132; the resonator 3122 in the block 3105 and, more specifically, the resonator 3122 in the monoblock 3102 via and through the RF signal bridge 3134; the other RF signal transmission output through-hole 3146 located in the step 3137 and, more specifically, located in the step 3138 defined in the end resonator 3122 of the monoblock 3103; back into the step 3137 and, more specifically, back into the step 3138 defined at the end of the resonator 3121 of the monoblock 3103; and out through the RF signal output pad 3801 located in the step 3137 and, more specifically, located in the step 3138 of the monoblock 3103.

In accordance with this embodiment of the present invention, the waveguide filter 3100 also defines and provides a pair of alternate or indirect- or cross-coupling RF signal transmission paths for RF signals generally designated by the arrows c in FIG. 3.

One of the cross-coupling or indirect electrical field/capacitive RF signal transmission paths c is defined and created by the external RF signal transmission line 3500 extending between the resonators 3116 and 3121 as described above and incorporated herein by reference which allows for the transmission of a small portion of the direct RF signal being transmitted through the resonator 3116 of the block 3105, and more specifically the resonator 3116 of the monoblock 3101, to be transmitted directly into the resonator 3121 of the block 3105, and more specifically the resonator 3121 of the monoblock 3103, via the external strip of conductive material 3504 which bridges and electrically interconnects the respective resonators 3116 and 3121 on the block 3105 and, more specifically, on the respective monoblocks 3101 and 3103.

The other cross-coupling or indirect magnetic/inductive RF signal transmission path c is defined and created by the interior or internal RF signal transmission means 3700, as described above and Incorporated herein by reference, which allows for the transmission of a small portion of the direct RF signal being transmitted through the resonator 3114 of the block 3105, and more specifically the resonator 3114 of the monoblock 3101, to be transmitted directly into the resonator 3122 of the block 3105, and more specifically the resonator 3122 of the monoblock 3103, via and through the interior or internal RF signal transmission window 3722 defined in the interior of the block 3105 in the region of and between the resonators 3114 and 3122.

In accordance with the invention, and in the same manner as described above with the respect to the waveguide filter 1100, it is understood that the cross-coupling of the RF signal as described above advantageously creates respective first and second pairs of transmission zeros, the first pair of which will be located below the passband of the waveguide filter 3100 and the second pair of which will be located above the passband of the waveguide filter 3100 as shown in FIG. 12 which is also representative of the performance/frequency response of the waveguide filter 3100 shown in FIG. 7.

Still further, in accordance with the present invention, and in the same manner as the waveguide filter 1100, the internal RF signal transmission window 3622 is designed/sized to create an inductive direct RF signal coupling stronger than the indirect- or cross-capacitive coupling created and defined by the external RF transmission line 3500 extending between and Interconnecting the respective resonators 3116 and 3121 which, in turn, is designed/sized to create an indirect cross-coupling stronger than the indirect, cross-coupling created and defined by the internal RF transmission window 3722 between and interconnecting the respective resonators 3114 and 3122.

The only difference is that, in the waveguide filter 3100, the RF signal is inputted into the block 3105 from the customer's motherboard via the RF signal input/output pad 3800 rather than an external connector and further is outputted into the customer's motherboard via the RF signal input/output pad 3801 on the block 3805.

Fifth Embodiment

It is understood that each of the waveguide filters 100, 1100, 2100, and 3100 have been shown in the FIGS. 1-8 as including two separate monoblocks which have been coupled and secured together. It is, however, understood that the invention encompasses single unitary block embodiments as shown in, for example, the single unitary block waveguide filter embodiment 4100 shown in FIGS. 9 and 10 and described below in more detail which has the same performance and operational characteristics and advantages as, for example, the two block waveguide filter embodiment 1100 shown in FIG. 3.

Figure 9:
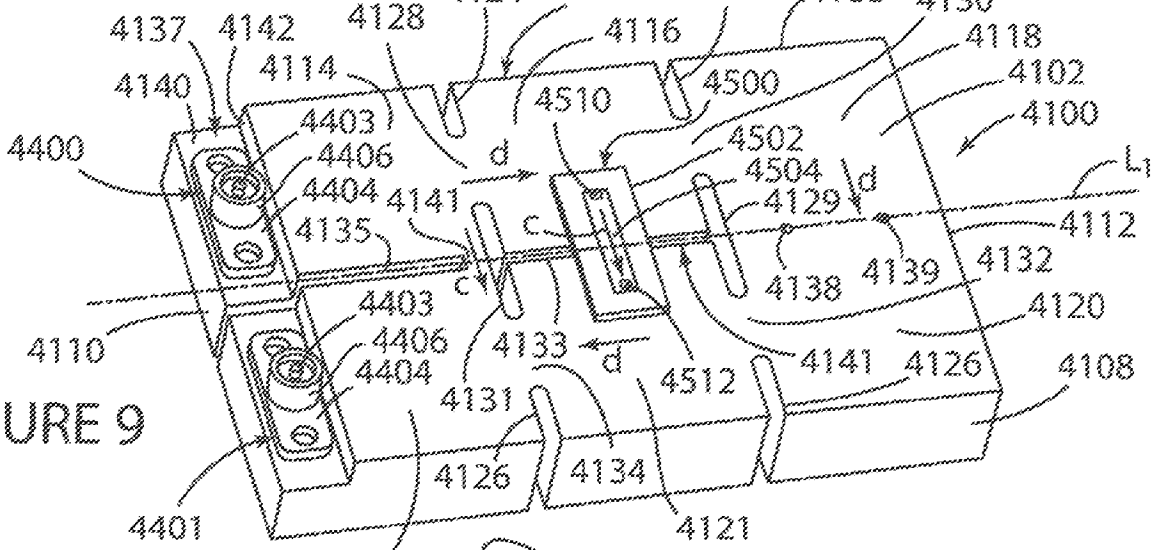
FIG. 9 is an enlarged top perspective view of yet a further embodiment of a dielectric waveguide filter according to the present invention.
Figure 10:
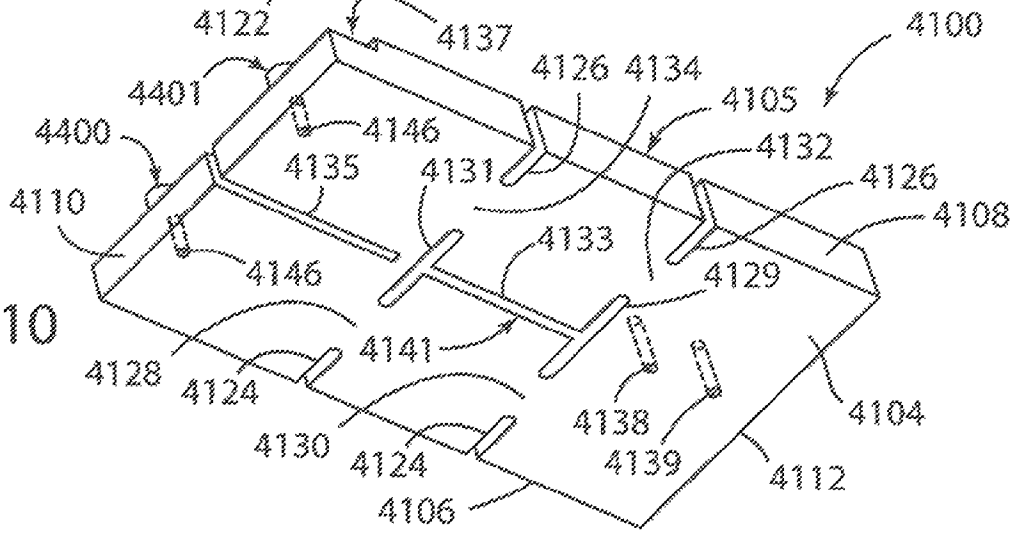
FIG. 10 is an enlarged bottom perspective view of the dielectric waveguide filter shown in FIG. 9.

Specifically, the waveguide filter 4100 shown in FIGS. 9 and 10 is made from a single, unitary generally parallelepiped-shaped monoblock 4105 which is comprised of a suitable dielectric material, such as for example ceramic; defines a longitudinal axis $L_1$; opposed and spaced-apart longitudinal horizontal exterior surfaces 4102 and 4104 extending longitudinally in the same direction as the longitudinal axis $L_1$; opposed longitudinal and spaced-apart side vertical exterior surfaces 4106 and 4108 extending longitudinally in the same direction as the longitudinal axis $L_1$; and opposed and spaced-apart transverse side vertical exterior end surfaces 4110 and 4112 extending in a direction generally normal to the longitudinal axis $L_1$ of the monoblock 4105.

The monoblock 4105 includes a plurality of resonant sections (also referred to as cavities or cells or resonators) 4114, 4116, and 4118 and 4120, 4121, and 4122 defined by respective slits and slots which have been cut and located in or on the monoblock 4101 as described in more detail below and arranged in a relationship in which the resonators 4114, 4116, and 4118 are arranged in a first column, the resonators 4120, 4121, and 4122 are arranged in a second column, the resonators 4114 and 4122 are arranged side by side in a first row, the resonators 4116 and 4121 are arranged side by side in a second row, and the resonators 4118 and 4120 are arranged side by side in a third row.

In the embodiment shown, two internal peripheral slots 4124 extend along the length of the side surface 4106 of the monoblock 4105 in a spaced-apart and parallel relationship. Each of the slots 4124 cuts through the side surface 4106 and the opposed horizontal surfaces 4102 and 4104 and partially through the body and the dielectric material of the monoblock 4105 in a relationship generally normal to the longitudinal axis $L_1$ of the monoblock 4105.

Two internal peripheral slots 4126 extend along the length of the opposed side surface 4108 of the monoblock 4105 in a spaced-apart and parallel relationship, and in a relationship opposed and co-linear with the respective slots 4124 defined in the side surface 4106. Each of the slots 4126 cuts through the side surface 4108 and the opposed horizontal surfaces 4102 and 4104 and partially through the body and the dielectric material of the monoblock 4105 in a relationship generally normal to the longitudinal axis $L_1$ of the monoblock 4105.

The monoblock 4105 still further defines and includes four additional slots or slots 4129, 4131, 4133, and 4135 as described in more detail below.

The generally oval-shaped and elongate slot 4129 is located and formed in the center of the monoblock 4101 and extends between, and in a relationship spaced to and co-linearly aligned with, the first pair peripheral slots 4124 and 4126 defined in the respective surfaces 4106 and 4108 of the monoblock 4105 and in a relationship generally normal to and intersecting the longitudinal axis $L_1$ of the monoblock 4105.

The slot 4131, which is also elongate and generally oval-shaped, is located and defined in the center of the monoblock 4101 in a relationship spaced and generally parallel to the slot 4129 and further extends between, and in a relationship spaced to and co-linearly aligned with, the second pair of peripheral slots 4124 and 4126 defined in the respective surfaces 4106 and 4108 of the monoblock 4105 and in a relationship generally normal to and intersecting the longitudinal axis $L_1$ of the monoblock 4105.

The slot 4133 is located and defined in the center of the monoblock 4101 and extends between and interconnects with the slots 4129 and 4131 in a relationship generally co-linear with the longitudinal axis $L_1$ of the monoblock 4105 so as to define a generally "I" shaped centrally located slot 4141 in the center of the monoblock 4101.

Another slot 4135 extends from the end surface 4110 of the monoblock 4101, cuts through the step 4136 defined in the monoblock 4101 and terminates in the body of the monoblock 4101 at a point spaced from the slot 4131. In the embodiment shown, the slot 4135 is positioned in a relationship generally co-linear with the slot 4133 and the longitudinal axis $L_1$ of the monoblock 4105 and in a relationship generally normal with the slots 4129 and 4131.

Thus, in accordance with this embodiment, the respective slots 4124, 4126, 4129, 4131, 4133, and 4135 have all been located and positioned in the monoblock 4105 in a relationship relative to each other so as to create and define the plurality of resonators 4114, 4116, 4118, 4120, 4121, and 4122 and the plurality of RF signal bridges 4128, 4130, 4132, and 4134 of dielectric material which extend between and interconnect the plurality of resonators 4114, 4116, 4118, 4120, 4121, and 4122.

In the embodiment shown, the bridge 4128 is defined between the slot 4124 in the surface 4106 of the monoblock 4105 and the slot 4131 and extends between and bridges and interconnects the dielectric material of the resonator 4114 to the dielectric material of the resonator 4116. The bridge 4130 is defined between the second slot 4124 in the surface 4106 of the monoblock 4105 and the slot 4129 and extends and bridges and interconnects the dielectric material of the resonator 4116 to the dielectric material of the resonator 4118. The bridge 4132 is defined between the slot 4126 in the surface 4108 of the monoblock 4105 and the slot 4129 and extends and bridges and interconnects the dielectric material of the resonator 4120 to the dielectric material of the resonator 4121. The bridge 4134 is defined between the other slot 4126 in the surface 4108 of the monoblock 4105 and the slot 4131 and extends and bridges the dielectric material of the resonator 4121 to the dielectric material of the resonator 4122.

Thus, in the relationship as shown in FIGS. 9 and 10, the respective resonators 4114 and 4122 are disposed in a side-by-side relationship and are separated from each other by the interior slot 4135 with the exception of another RF signal bridge 4141 of dielectric material located between the slots 4135 and 4131; the respective resonators 3116 and 3121 are disposed in a side-by-side relationship and are separated from each other by the interior slot 4133; and the respective resonators 3118 and 3120 are disposed in an abutting, side-by-side relationship.

In the embodiment shown, the width of each of the RF signal bridges 4128, 4130, 4132, 4134, and 4141 is dependent upon the distance between the respective slots 4124, 4126, 4129, and 4131.

Although not shown in any of the FIGURES, it is understood that the thickness or width of the respective slits and slots and the depth or distance which the slits and slots described above extend into the body of the monoblock 4105 may be varied depending upon the particular application to allow the width and the length of the respective RF signal bridges to be varied accordingly to allow control of the electrical coupling and bandwidth of the waveguide filter 4100 and hence control the performance characteristics of the waveguide filter 4100.

The monoblock 4105 additionally comprises and defines an end step or notch 4136 comprising, in the embodiment shown, a generally L-shaped recessed or grooved or shouldered or notched region or section of the longitudinal surface 104, opposed side surfaces 106 and 108, and opposed side end surfaces 110 and 112 of the monoblock 101, and more specifically, the end resonators 4114 and 4122, from which dielectric ceramic material has been removed or is absent.

Stated another way, the step 4136 is defined in and by an end section or region 4170 of the resonators 4114 and 4122 and the monoblock 4105 having a height less than the height of the remainder of the monoblock 4105.

Stated yet another way, the step 4136 comprises a generally L-shaped recessed or notched portion of the respective end resonators 4114 and 4122 defined on the monoblock 4105 which includes a first generally horizontal surface 4140 located or directed inwardly of, spaced from, and parallel to the surface 4104 of the monoblock 4105 and extending between the opposed side exterior surfaces 4106 and 4108 of the monoblock 4105 in a relationship generally normal to and intersecting the longitudinal axis $L_1$ of the monoblock 4105 and a second generally vertical surface or wall 4142 located or directed inwardly of, spaced from, and parallel to, the respective side end surface 4110 of the monoblock 4105 and extending between the opposed side exterior surfaces 4106 and 4108 of the monoblock 4105 in a relationship generally normal to and intersecting the longitudinal axis $L_1$ of the monoblock 4105.

In the embodiment shown, the slot 4135 extends through and separates the step 4137 into respective upper and lower separate step portions located respectively above and below the longitudinal axis $L_1$ of the monoblock 4105.

The monoblock 4105 additionally comprises a pair of electrical RF signal input/output electrodes in the form of respective through-holes 4146 (FIG. 10) extending through the body of the monoblock 4105 and, more specifically, through the step 4136 and, still more specifically, through the body of the respective end resonators 4114 and 4122 defined in the monoblock 4105 between, and in relationship generally normal to, the surface 4140 of the step 4136 and the surface 4102 of the monoblock 4101.

Still more specifically, the respective RF signal input/output through-holes 4146 are spaced from and generally parallel to the transverse side end surface 4110 of the monoblock 4105 and define respective generally circular openings located and terminating in the step surface 4140 and the monoblock surface 4104 respectively.

The RF signal input/output through-holes 4146 are located and positioned in and extend through the interior and dielectric material of the monoblock 4105 and the step 4137 between and, in a relationship generally spaced from and parallel to, the side end surface 4110 and the step wall or surface 4142. One of the through-holes 4146 is located on the portion of step 4137 located above the longitudinal axis $L_1$ and the slot 4135 defined therein, while the other through-hole 4146 is located in the portion of the step 4137 located below the longitudinal axis $L_1$ and the slot 4135 defined therein.

The monoblock 4105 still further defines a pair of additional spaced-apart through-holes 4137 and 4139 which are located and defined in and extend through the body and dielectric material of the monoblock 4105 in the region of the monoblock 4105 located between the slot 4129 and the end surface 4112 of the monoblock 4101 and further in a relationship generally co-linear with the slot 4133 and the longitudinal axis $L_1$ of the monoblock 4105 and normal to the block surfaces 4102 and 4104. The through-holes 4137 and 4139 define respective openings in the top and bottom exterior surfaces 4102 and 4104 of the monoblock 4105 and are located between the resonators 4118 and 4120.

All of the external surfaces 4102, 4104, 4106, 4108, 4110, and 4112 of the monoblock 4105, the internal surfaces of the slots 4124, 4126, 4129, 4131, 4133, and 4135, and the internal surfaces of the RF signal input/output through-holes 4146 are covered with a suitable conductive material, such as for example silver, with the exception of the regions discussed below in more detail.

The monoblock 4105 still further comprises respective SMA RF signal input/output co-axial connectors 4400 and 4401, each including a generally rectangularly-shaped connector base plate or flange 4404, a generally cylindrically-shaped connector housing or shell 4406 extending generally normally unitarily upwardly and outwardly from the top surface of the flange 4404, and an elongated center connector pin 4403 extending through both the interior of the shell 4406 and the body of the flange 4404.

The respective connectors 4400 and 4401 are seated against the step 4136 of the monoblock 4105 in a relationship and direction generally normal to the side surfaces 4106 and 4108 of the monoblock 4105, and the longitudinal axis $L_1$, wherein the flange 4404 of the respective connectors 4400 and 4401 are seated against the surface 4140 of the step 4136 and the shell 4406 is co-axially aligned with the respective through-holes 4146 defined in the step 4136.

The connector flange 4404 is directly soldered to the surface 4140 of the step 4136 of the monoblock 4105 and the connector pin 4403 is reflow-soldered into the respective through-holes 146.

In the embodiment shown, the connector 4400 is seated on the portion of the step 4137 located above the longitudinal axis $L_1$ and the slot 4135 defined therein, while the connector 4401 is seated on the portion of the step 4137 located below the longitudinal axis $L_1$ and the slot 4135 defined therein.

The waveguide filter 4100 also comprises an external, cross-coupling/indirect coupling, bypass or alternate RF signal transmission electrode or bridge member or line or means 4500 having a specific impedance and phase and extending between and interconnecting and electrically coupling the respective resonators 4116 and 4121 of the monoblock 4105.

The external cross-coupling transmission line 4500 includes and is defined by a generally rectangularly-shaped printed circuit board 4502 which is seated on and bridges the slot 4133 on the top surface 4102 of the monoblock 4105. The external cross-coupling transmission electrode 4500 additionally includes an elongated strip of conductive material 4504 defined and formed on the top surface of the printed circuit board 4502 which bridges and extends over the respective resonators 4116 and 4121 on the monoblock 4105.

Moreover, and although not shown in FIG. 9, it is understood that the printed circuit board 4502 additionally includes and defines respective internal through-holes extending through the body of the printed circuit board 4502 and adapted to receive respective conductive posts 4510 and 4512 extending outwardly from the top surface 4102 of the respective resonators 4116 and 4121 into contact with opposed end sections of the strip 4504 for electrically coupling the resonators 4116 and 4121.

In the embodiment shown, the external transmission line 4500 is located between and spaced from the slots 4129 and 4131 and intersects the longitudinal axis $L_1$.

The waveguide filter 4100 still further comprises an interior or internal direct inductive coupling RF signal transmission means 4600 defined by the through-holes 4138 and 4139 and extending and located between and interconnecting and coupling the respective resonators 4118 and 4120 and defining an interior or internal path for the transmission of the RF signal from the resonator 4118 into the resonator 4120.

In accordance with the invention, the waveguide filter 4100, which provides the same performance and operational advantages and characteristics of the waveguide filter 1100, defines a first magnetic or inductive generally U-shaped direct coupling RF signal transmission path for RF signals generally designated by the arrows d in FIG. 9, successively through the connector 4400 in the embodiment where the connector 4400 defines the RF signal input connector; the RF signal input/output through-hole 4146 located in the portion of the step 4137 located above the longitudinal axis $L_1$ and the slot 4135; the resonator 4114; the resonator 4116 via and through the bridge 4128 of dielectric material; the resonator 4118 via and through the bridge 4130 of dielectric material; the resonator 4120 via the internal RF signal transmission means 4600 defined in the interior of the block 4105 between the resonators 4118 and 4120 by the respective interior through-holes 4138 and 4139; the resonator 4121 via and through the bridge 4132 of dielectric material; the resonator 4122 via and through the bridge 4134 of dielectric material; the portion of the step 4137 located below the longitudinal axis $L_1$ and the slot 4135; the RF signal input/output through-hole 4146 located in the portion of the step 4137 located below the longitudinal axis $L_1$; and out through the RF signal output connector 4401.

In accordance with this embodiment, the waveguide filter 4100 also defines a first alternate or indirect or cross-coupling external RF signal transmission path for RF signals generally designated by the arrow c in FIG. 9 and defined and created by the external RF signal transmission line 4500 which allows for the external transmission of a small portion of the direct RF signal being transmitted through the resonator 4116 to be transmitted directly into the resonator 4121 via the external strip of conductive material 4504 which bridges the slot 4133 and electrically interconnects the respective resonators 4116 and 4121.

In accordance with this embodiment, the slot 4135 prevents any cross-coupling or transmission of the RF signal directly from the resonator 4114 into the resonator 4122 with the exception of a small portion which is transmitted from the resonator 4114 to the resonator 4122 via and through the RF signal bridge 4141 and the transmission path generally designated by the second arrow c in FIG. 9 and which defines a second alternate or indirect or cross-coupling RF signal transmission path for RF signals similar to the second alternate or indirect or cross-coupling path created by the internal window 1722 of the waveguide filter 1100 shown in FIGS. 3 and 4.

The slot 4133 prevents any cross-coupling or transmission of the RF signal directly from the resonator 4116 into the resonator 4121 except of course through the external cross-coupling electrode 4500 as described above.

In accordance with the invention, the cross-coupling of the RF signal in the monoblock 4101 as described in detail above advantageously creates the same first and second pairs of transmission zeros as described above with respect to the waveguide filter 1100 and thus incorporated herein by reference and shown in FIG. 12 which is also representative of the performance/frequency response of the waveguide filter 4100 shown in FIG. 9.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

I claim:

1. A waveguide filter for the transmission of an RF signal comprising:

a first block of dielectric material including at least a first slot separating and thus defining a first plurality of resonators in the first block of dielectric material, the first block of dielectric material being covered with a layer of conductive material;

a second block of dielectric material coupled to the first block of dielectric material, the second block of dielectric material including at least a second slot separating and thus defining a second plurality of resonators in the second block of dielectric material, the second block of dielectric material being covered with a layer of conductive material;

a first RF signal input/output electrode defined on the first block of dielectric material defined by a first through-hole extending through a first step terminating in a first exterior surface spaced from the at least first slot defined in the first block of dielectric material; and a first direct RF signal transmission path defined by the combination of the first RF signal input/output electrode and the plurality of resonators in the first and second blocks of dielectric material, the first direct RF signal transmission path being defined in part by an internal window for transmitting the RF signal between one of the first plurality of resonators in the first block of dielectric material and one of the second plurality of resonators in the second block of dielectric material, the internal window being defined by respective first and second regions on the respective first and second blocks of dielectric material that are devoid of conductive material.

2. The waveguide filter of claim 1 wherein a first indirect RF signal transmission path is defined in part by a first indirect RF signal transmission means extending from a second one of the plurality of resonators in the first block of dielectric material to a second one of the plurality of resonators in the second block of dielectric material, the first indirect RF signal transmission means being another internal window for transmitting the RF signal between the second one of the first plurality of resonators in the first block of dielectric material and the second one of the second plurality of resonators in the second block of dielectric material, the another internal window being defined by respective third and fourth regions on the respective first and second blocks of dielectric material that are devoid of conductive material.

3. The waveguide filter of claim 2 defining a longitudinal axis and wherein the first and second blocks of dielectric material are coupled together in a side-by-side relationship along respective first exterior side surfaces thereof, the conductive material covering the first and second blocks of dielectric material defining an interior layer of conductive material between the first and second blocks of dielectric material and co-linear with the longitudinal axis of the waveguide filter, the first and second internal windows being defined in the interior layer of conductive material.

4. A waveguide filter for the transmission of an RF signal comprising:

first and second blocks of dielectric material each including an exterior surface covered with a layer of conductive material and coupled together;

at least a first resonator defined in each of the first and second blocks of dielectric material;

a second resonator defined in the first block of dielectric material and separated from the at least first resonator in the first block of dielectric material by a first slot and a first bridge for transmitting the RF signal between the at least first resonator and the second resonator in the first block of dielectric material;

an interior layer of conductive material defined between the first and second blocks of dielectric material by the layer of conductive material when the first and second blocks of dielectric material are coupled together; and a region in the interior layer of conductive material between the first and second blocks of dielectric material devoid of conductive material and defining a first RF signal transmission window for the transmission of the RF signal between the at least first resonator in the first block of dielectric material and the at least first resonator in the second block of dielectric material when the first and second blocks of dielectric material are coupled together.

5. The waveguide filter of claim 4 further comprising a second resonator defined in the second block of dielectric material and separated from the at least first resonator in the second block of dielectric material by a second slot and a second bridge for transmitting the RF signal between the first and second resonators in the second block of dielectric material.

6. The waveguide filter of claim 5 wherein each of the first and second blocks of dielectric material includes a first exterior side surface, the first and second blocks of dielectric material being coupled together in a side-by-side relationship along the respective first exterior side surfaces thereof, the waveguide filter defining a longitudinal axis, the interior layer of conductive material and the RF signal transmission window being co-linearly aligned with the longitudinal axis and the first and second slots being arranged on opposite sides of and in a relationship normal to the longitudinal axis of the waveguide filter.

7. The waveguide filter of claim 6 wherein the firs rid second slots in the first and second blocks of dielectric material face each other.

8. The waveguide filter of claim 4 wherein each of first and second blocks of dielectric material includes a first exterior side surface, the first and second blocks of dielectric material being coupled together in a side-by-side relationship along the respective first exterior side surfaces thereof, the waveguide filter defining a longitudinal axis and the interior layer of conductive material and the first RF signal transmission window extending in a relationship co-linear with the longitudinal axis of the waveguide filter.

9. A waveguide filter for the transmission of an RF signal comprising:

first and second blocks of dielectric material each including an exterior surface and a first exterior side surface and coupled together in a side-by-side relationship along the respective first exterior side surfaces thereof;

at least first and second resonators defined in the first block of dielectric material and separated by a first slot defined in the first block of dielectric material and a first RF signal transmission bridge for the transmission of the RF signal between the first and second resonators in the first block of dielectric material;

at least third and fourth resonators defined in the second block of dielectric material and separated by a second slot defined in the second block of dielectric material and a second RF signal transmission bridge for the transmission of the RF signal between the third and fourth resonators in the second block of dielectric material;

a layer of conductive material covering the exterior surface of each of the first and second blocks of dielectric material and together defining an interior layer of conductive material between the first and second blocks of dielectric material when the first and second blocks of dielectric material are coupled together in the side-by-side relationship, the waveguide filter defining a longitudinal axis and the interior layer of conductive material extending in a relationship co-linear with the longitudinal axis;

a region in the interior layer of conductive material being devoid of conductive material and defining a first RF signal transmission window for the transmission of the RF signal between one of the first and second resonators in the first block of dielectric material and one of the third and fourth resonators in the second block of dielectric material when the first and second blocks of dielectric material are coupled together.

10. The waveguide filter of claim 9 further comprising another region in the interior layer of conductive material between the first and second blocks of dielectric material that is devoid of conductive material and defining a second RF signal transmission window for the transmission of the RF signal between one of the first and second resonators in the first block of dielectric material and one of the third and fourth resonators in the second block of dielectric material when the first and second blocks of dielectric material are coupled together.

11. The waveguide filter of claim 9 wherein the first and second slots defined in the first and second blocks of dielectric material face each other and are positioned on opposite sides of and in a relationship normal to the longitudinal axis of the waveguide filter.

* * * * *